US007473841B2

(12) United States Patent
Fujiwara

(10) Patent No.: US 7,473,841 B2
(45) Date of Patent: Jan. 6, 2009

(54) AUTOMATIC PLAYER CAPABLE OF REPRODUCING STOP-AND-GO KEY MOTION AND MUSICAL INSTRUMENT USING THE SAME

(75) Inventor: Yuji Fujiwara, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 338 days.

(21) Appl. No.: 11/343,848

(22) Filed: Jan. 31, 2006

(65) Prior Publication Data

US 2006/0185503 A1 Aug. 24, 2006

(30) Foreign Application Priority Data

Feb. 24, 2005 (JP) ..... 2005-049248

(51) Int. Cl.
*G10F 1/02* (2006.01)

(52) U.S. Cl. ..... 84/615; 84/653; 84/20; 84/21

(58) Field of Classification Search ..... 84/600, 84/609, 649, 653, 13, 19–23; 318/565, 621, 318/626, 638, 687, 686
See application file for complete search history.

(56) References Cited

U.S. PATENT DOCUMENTS 5,131,306 A * 7/1992 Yamamoto ..... 84/19
5,530,198 A * 6/1996 Ishii ..... 84/21
5,652,399 A * 7/1997 Fujiwara et al. ..... 84/21
5,691,489 A * 11/1997 Fujiwara et al. ..... 84/21
5,731,530 A * 3/1998 Fujiwara et al. ..... 84/21
5,739,450 A * 4/1998 Fujiwara et al. ..... 84/462
5,880,393 A * 3/1999 Kaneko et al. ..... 84/662
6,051,762 A * 4/2000 Fujiwara et al. ..... 84/21
6,359,207 B1 * 3/2002 Oba et al. ..... 84/658
6,403,872 B2 * 6/2002 Muramatsu et al. ..... 84/724
6,900,379 B2 * 5/2005 Eugene et al. ..... 84/103
6,969,791 B2 * 11/2005 Fujiwara ..... 84/13
2001/0003945 A1 * 6/2001 Muramatsu et al. ..... 84/658

FOREIGN PATENT DOCUMENTS

JP 07-175471 7/1995

* cited by examiner

*Primary Examiner*—David S. Warren
(74) *Attorney, Agent, or Firm*—Harness, Dickey & Pierce, PLC

(57) ABSTRACT

A servo controller of an automatic player piano normalizes an actual key position to a value less than a reference value indicative of a target stop on a reference trajectory when the key is found in a region immediately before the target stop and to another value greater than the reference value when the key exceeds the target stop, and adjusts a driving signal to a proper value in such a manner that a solenoid-operated key actuator minimizes the difference between the value or another value and the reference value, whereby the servo controller keeps the key in a narrow region on both sides of the target stop for reproducing stop-and-go key motion.

20 Claims, 13 Drawing Sheets

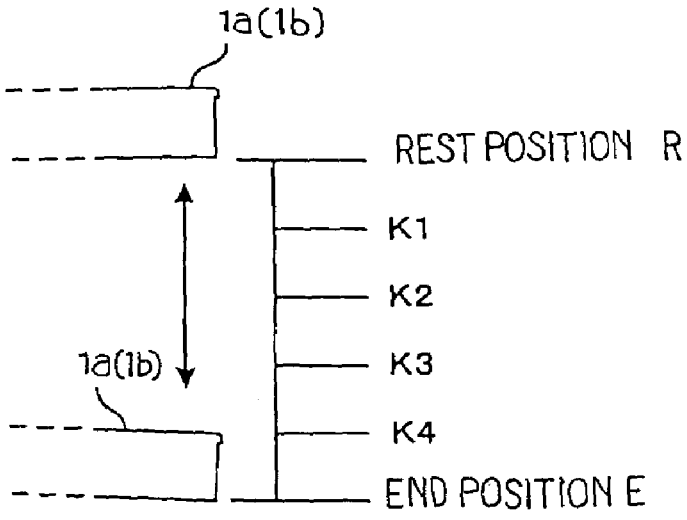
Fig. 2
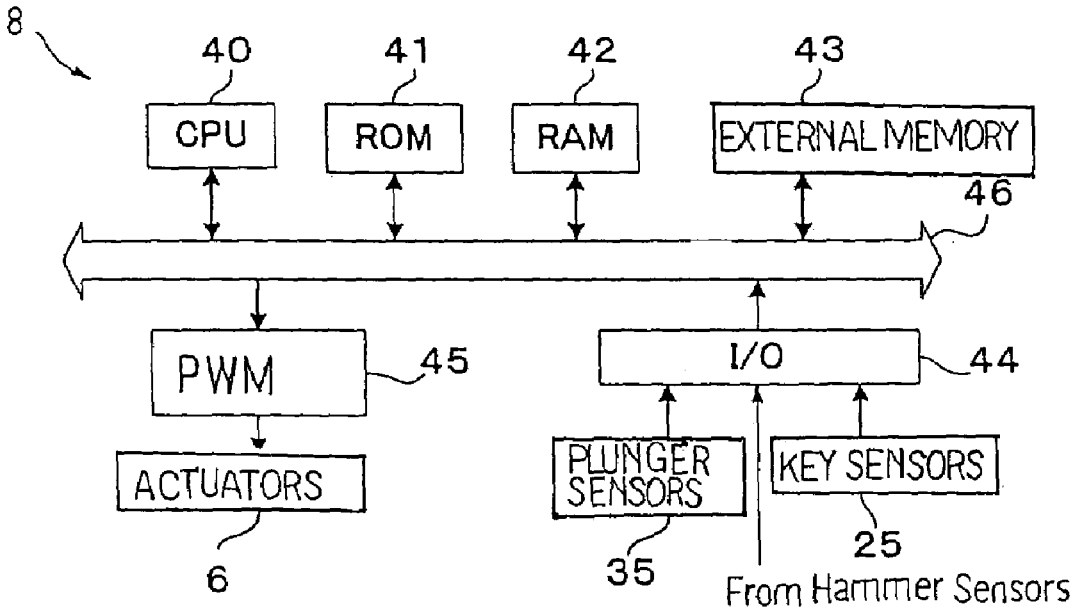
Fig. 3
| | |
|---|---|
| t | x |
| t | v |
| t | Kn |
| ⋮ | ⋮ |
Fig. 4

AUTOMATIC PLAYER CAPABLE OF REPRODUCING STOP-AND-GO KEY MOTION AND MUSICAL INSTRUMENT USING THE SAME

FIELD OF THE INVENTION

This invention relates to an automatic player and, more particularly, to an automatic player incorporated in a musical instrument for reproducing key motion in playback.

DESCRIPTION OF THE RELATED ART

A servo controlling technique is, by way of example, employed in a hybrid musical instrument such as, for example, an automatic player piano for playback. The hybrid musical instrument is fabricated on the basis of an acoustic musical instrument, and an electric system is installed in the acoustic musical instrument for assisting a human player in playback. For example, the automatic player piano is fabricated on the basis of an acoustic piano, and an automatic player reenacts a performance on the acoustic piano. In order to reproduce the key motion at high fidelity, a servo controlling technique is employed in the automatic player.

A piece of music is played on the acoustic piano, and the original performance is expressed by a set of music data codes. When a user instructs the automatic player to reenact a piece of music, the automatic player starts sequentially to analyze the music data codes, and selectively gives rise to the original key motion. Thus, the automatic player is expected to reproduce the key motion in various styles of rendition same as those in the original performance.

The original performance is usually recorded through a recorder, and several sorts of system components are shared between the recorder and the automatic player. For example, although different subroutine programs are prepared for the recorder and automatic player, these subroutine programs selectively run on a central processing unit shared between the recorder and the automatic player. However, the other system components are prepared only for the automatic player or recorder. Thus, the shared system components and exclusively used system components form in combination the electric system.

A typical example of the electric system is disclosed in Japanese Patent Application laid-open No. Hei 7-175471. The prior art electric system includes key sensors, hammer sensors, plunger sensors solenoid-operated key actuators and a controller. The key sensors and hammer sensors are exclusively used in the recording. The plunger sensors and solenoid-operated key actuators are exclusively used in the automatic playing, and form in combination a servo control loop together with the controller. However, the controller is shared between the recorder and the automatic player.

The key sensors are of the optical position transducer, and the plunger sensors are categorized in an MM (Moving Magnet) type velocity sensor. Each of the hammer sensors is implemented by two photo couplers, and the hammer shank intermittently interrupts the light beams thrown across the trajectory thereof. The controller determines the time at which the hammer is brought into collision with the string and the hammer velocity immediately before the collision. Each of the key sensors is implemented by a shutter plate, which is attached to the associated key, and two photo couplers arranged along the trajectory of the shutter plate. While the key is traveling from the rest position to the end position, the shutter plate sequentially interrupts the light beams thrown across the trajectory, and the controller determines the time to release the key and velocity in the backward motion.

The prior art electric system aims at reproduction of the half-stroke key motion in the certain style of rendition such as the repetition. In case where a key travels from the rest position to the end position without any stoppage, the key motion is hereinafter referred to as "full-stroke key motion". The controller analyzes the music data codes expressing the upward key motion and next downward key motion so as to approximate the upward key trajectory and downward key trajectory to linear lines. The controller checks the linear lines to see whether or not they cross each other anywhere between the rest position and the end position. If the answer is given affirmative, the controller changes the key motion from the upward direction to the downward direction at the crossing point so as to reproduce the half-stroke key motion. Thus, the prior art electric system reproduces the half-stroke key motion as well as the full-stroke key motion.

The subroutine program, which runs on the data processor in the prior art controller, is designed to reproduce the half-stroke key motion, and the servo control loop, which is formed by the solenoid-operated key actuators, plunger sensors and controller, forces the keys to travel on the target trajectories for the half-stroke key motion.

Although the prior art electric system can reproduce the half-stroke key motion, it is difficult to reproduce the stop-and-go key motion. A key behaves in the stop-and-go key motion as follows. The key is downwardly moved toward the end position, and is stopped at a certain point on the way to the end position. The key is maintained at the point for a certain time period, and, thereafter, is made restart toward the end position or return to the rest position. Thus, the stop-and-go key motion contains continuous motion to the certain point, stoppage at the certain point and continuous motion from the certain point. Term "continuous key motion" is opposite to the stop-and-go key motion. The key travels from the rest position to the end position without any stoppage. The continuous key motion contains only the continuous motion.

The prior art electric system sometimes fails to discriminate the stop-and-go key motion from the continuous key motion. In the half-stroke key motion, the certain time period is so short that the linear lines can surely cross each other at between the rest position and the end position. However, the pianist sometimes keeps the key at the certain point for a long time period in the stop-and-go key motion. In this situation, the linear lines do not cross each other. When the pianist restarts the upward key motion or downward key motion after the stoppage, the linear lines do not cross each other. Thus, the prior art electric system can not deal with the stop-and-go key motion.

Moreover, the prior art controller can not stop the keys at target stops. In other words, the keys are gradually moved over the target stops. This is because of the fact that the servo control loop, which is established in the prior art electric system, compares the current key positions with the target stops to see whether or not the keys exactly travel on the target trajectories. In the prior art electric system, the feedback signals are supplied from the plunger velocity sensors to the controller, and the controller determines the current plunger positions, i.e., the current key positions through the integration on the pieces of velocity data. Since the plunger velocity signals are amplified through the operational amplifiers, noise components are unavoidably introduced in the pieces of velocity data due to the offset voltage in the operational amplifiers, and the noise components are accumulated through the integration. Thus, the controller makes the decision on the servo control through the comparison with the pieces of inaccurate position data. As a result, the keys do not stop at the target stop. In other words, the prior art electric system can not reproduce the stop-and-go motion.

SUMMARY OF THE INVENTION

It is therefore an important object of the present invention to provide a playback system, which can produce the stop-and-go key motion.

It is also an important object of the present invention to provide a musical instrument, which is equipped with the playback system.

To accomplish the object, the present invention proposes to exert force in the direction same as the direction of key motion always in a region before target stop and in the direction opposite to the direction of key motion always in another region over the target stop.

In accordance with one aspect of the present invention, there is provided a n automatic player for producing at least stop-and-go motion of manipulators of a musical instrument comprising actuators provided in association with the manipulators, respectively, and responsive to driving signals so as to exert force on the associated manipulators, thereby moving the associated manipulators along reference trajectories on which a target stop is determined for the stop-and-go motion, sensors monitoring the manipulators for producing signals representative of pieces of motion data expressing actual motion of the manipulators on actual trajectories, and a data processing unit including a motion controller determining pieces of control data expressing target motion of the manipulators on the reference trajectories, and outputting the pieces of control data at time intervals and a servo controller connected to the sensors, the motion controller and the actuators for a servo control on the manipulators, normalizing the pieces of motion data in such a manner as to express the force in a direction same as the direction of the actual motion for the manipulators advancing toward the target stop and in another direction opposite to the direction of the actual motion for the manipulators running over the target stop and adjusting the driving signal to a proper value of magnitude through minimization of a difference between the pieces of motion data already normalized and the pieces of control data.

In accordance with another aspect of the present invention, there is provided a musical instrument for producing tones through at least stop-and-go motion comprising manipulators selectively moved in the at least stop-and-go motion for specifying an attribute of tones to be produced, a linkwork connected to the manipulators so that the manipulators give rise to motion of the linkwork, and an automatic player 1 for producing the at least stop-and-go motion of the manipulators and including actuators provided in association with the manipulators, respectively, and responsive to driving signals so as to exert force on the associated manipulators, thereby moving the associated manipulators through the stop-and-go motion along reference trajectories on which a target stop is determined, sensors monitoring the manipulators for producing signals representative of pieces of motion data expressing actual motion of the manipulators on actual trajectories and a data processing unit having a motion controller determining pieces of control data expressing target motion of the manipulators on the reference trajectories, and outputting the pieces of control data at time intervals and a servo controller connected to the sensors, the motion controller and the actuators for a servo control on the manipulators, normalizing the pieces of motion data in such a manner as to express the force in a direction same as the direction of the actual motion for the manipulators advancing toward the target stop and in another direction opposite to the direction of the actual motion for the manipulators running over the target stop and adjusting the driving signal to a proper value of magnitude through minimization of a difference between the pieces of motion data already normalized and the pieces of control data.

BRIEF DESCRIPTION OF THE DRAWINGS

The features and advantages of the automatic player and musical instrument will be more clearly understood from the following description taken in conjunction with the accompanying drawings, in which FIG. 2 is a schematic side view showing a key moved between a rest position and an end position, FIG. 3 is a block diagram showing the system configuration of a controller incorporated in the musical instrument, FIG. 4 is a view showing a data format for a piece of playback data.

DESCRIPTION OF THE PREFERRED EMBODIMENTS

Figure 1:
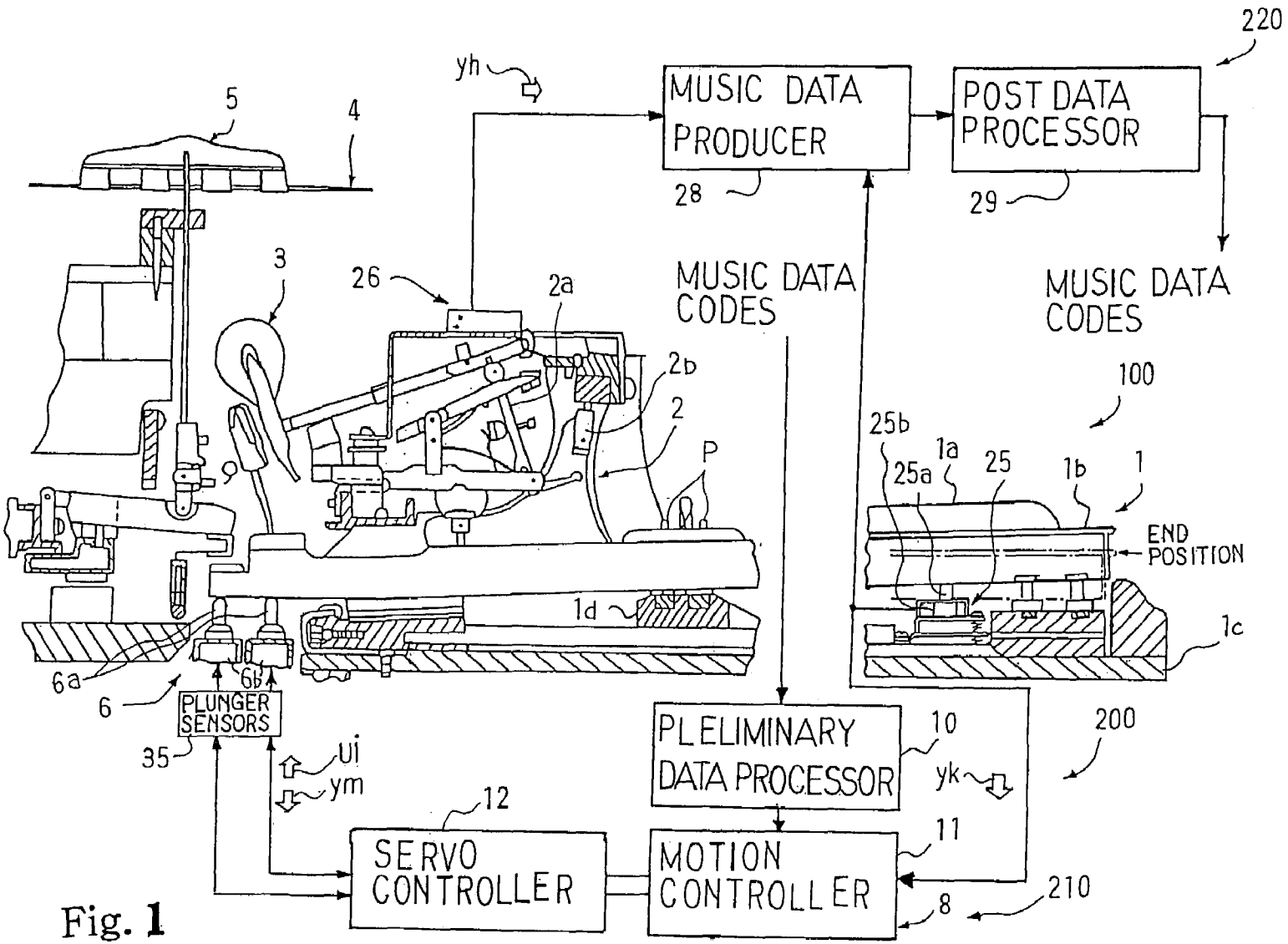
FIG. 1 is a cross sectional side view showing the structure of a musical instrument according to the present invention.

A musical instrument embodying the present invention largely comprises manipulators, a linkwork and an automatic player. The manipulators are selectively moved for specifying an attribute of tones such as, for example, the pitch or an effect. The manipulators are connected to the linkwork, and give rise to predetermined motion of the linkwork. It is possible to give various sorts of motion to the linkwork. For example, the linkwork may selectively strike strings through rotation of components such as hammers so as to produce tones featured by the attribute. The linkwork may close or open switches connected to an electronic tone generator. Another example of the predetermined motion is simply to give resistance against the motion of the manipulators without any production of tones. The resistance may be called as "key touch".

The automatic player is provided in association with the manipulators for a playback, music education and an exhibition, by way of example. The automatic player is assumed to reenact a performance. The automatic player selectively gives rise to the motion of the manipulators, and the manipulators make the linkwork to produce the tones. While a user was recording a performance on the manipulators, the user usually gave rise to continuous motion, which was continuous motion from a rest position to an end position without any stop at an intermediate point on a trajectory. However, the user might move the manipulators in stop-and-go motion, which expressed existence of a stop on the trajectory in the continuous motion. The automatic reproduces the continuous motion, stop-and-go motion and other sorts of motion in the playback.

In case where the automatic player serves as a music tutor, the music tutor makes the manipulators slightly sunk for guiding the fingers of a trainee. The trainee depresses the manipulators, and the music tutor evaluates the fingering. Thus, the music tutor gives the trainee the guide for the fingering through the stop-and-go motion.

When a user requests an exhibition to the automatic player, the automatic player sequentially moves the manipulators in the stop-and-go motion so that the manipulators are laid on a fine pattern such as a wave pattern. The automatic player may stepwise change the depth of the manipulators as if the wave proceeds through the array of manipulators.

The automatic player produces or reproduces the stop-and-go motion by means of actuators, sensors and a data processing unit. The actuators are provided in association with the manipulators, and are responsive to driving signals supplied from the data processing unit. The driving signal is assumed to energize one of the manipulators. The actuator exerts force on the manipulator so as to move the manipulator on a reference trajectory, which means a target position varied with time. While the manipulator is traveling, the sensor monitors the manipulator so as to produce a signal, and supplies the signal to the data processing unit for a serve control on the manipulator. The signal is representative of a piece of motion data, which expresses actual motion of the manipulator on an actual trajectory.

The data processing unit includes a motion controller and a servo controller for the servo control on the manipulators. The motion controller determines pieces of control data expressing the target position on the reference trajectory, and outputs the pieces of control data to the servo controller at time intervals. The servo controller carries out the servo control on the basis of the pieces of motion data and pieces of control data as follows. Description is made on the servo control for the stop-and-go motion with the assumption that one of the manipulators starts to travel on the reference trajectory. A target stop has been already determined on the reference trajectory.

First, the servo controller normalizes the piece of motion data as follows. If the manipulator has not reached a target stop, yet, the piece of motion data is normalized to express the force in a direction same as the direction of the actual motion of the manipulator. The force keeps the manipulator to advance toward the target stop. On the other hand, if the manipulator has already overrun the target stop, the piece of motion data is normalized to express the force in another direction opposite to the direction of the actual motion. The force causes the manipulator to go back toward the target stop. If the manipulator runs over the target stop, again, the manipulator is found between the rest position and the target stop, and the servo controller normalizes the piece of motion data to express the force against the motion. Thus, the servo controller normalizes the piece of motion data in order to confine the manipulator in a narrow region around the target stop.

When the piece of motion data is normalized, the servo controller adjusts the driving signal to a proper value of magnitude in such a manner as to minimize a difference between the pieces of motion data and the piece of normalized motion data. This results in the confinement in the narrow region around the target stop. The users seem the manipulator to stop at the target stop.

In the following description, term "front" is indicative of a position closer to a player, who is sitting on a stool for fingering, than another position modified with term "rear", and a line, which is drawn between a front position and a corresponding rear position, extends in a "fore-and-aft direction". A lateral direction crosses the fore-and-aft direction at right angle, and an up-and-down direction is normal to the plane defined by the fore-and-aft direction and lateral direction.

When the player depresses the front portion of a key, his or her finger gives rise to "downward key motion". On the other hand, the term "upward key motion" is opposite in direction to the downward key motion. The term "key motion" includes the downward key motion and upward key motion.

First Embodiment

An automatic player piano embodying the present invention largely comprises an acoustic piano 100 and an electric system 200. The electric system 200 is installed in the acoustic piano 100, and has a data processing capability. Users enjoy pieces of music with and without assistance of the electric system 200 as follows.

The user fingers pieces of music on the acoustic piano, and the fingering gives rise to acoustic piano tones through the acoustic piano 100. Thus, the users enjoy the pieces of music without any assistance of the electric system 200.

The electric system 200 serves as at least an automatic player 210 and a recorder 220. A user is assumed to instruct the electric system 200 to record his or her performance on the acoustic piano 100. The recorder 220 analyzes pieces of position data expressing the fingering and pedaling, and produces a set of music data codes representative of the performance through the analysis. When the user requests the electric system 200 to reenact a performance, the automatic player 210 starts to finer the piece of music on the acoustic piano 100, and produces the acoustic tones along the music passage without any fingering of a human player. Thus, the users enjoy the pieces of music with the assistance of the electric system 200.

Acoustic Piano

In this instance, the acoustic piano 100 is a grand piano. Of course, an upright piano is available for the automatic player piano. The acoustic piano 100 includes a keyboard 1, in which black keys 1*a* and white keys 1*b* are incorporated, key action units 2, hammers 3, strings 4 and dampers 5. The keyboard 1 is mounted on a front portion of a key bed 1*c*, which forms a part of a piano cabinet, and is exposed to a pianist, who is sitting on a stool (not shown) in front of the piano cabinet for playing a piece of music. The action units 2, hammers 3, strings 4 and dampers 5 are housed inside the piano cabinet, and the inner space is open to the ambience while a top board (not shown) is folded.

The black keys 1*a* and white keys 1*b* extend in the fore-and-aft direction, and are laid on the well-known pattern in the lateral direction. In this instance, eighty-eight keys 1*a*/1*b* are incorporated in the keyboard 1. A balance rail 1*d* laterally extends over the key bed 1*c*, and the black keys 1*a* and white keys 1*b* rest on the balance rail 1*d*. Balance pins P upwardly project from the balance rail 1*d* at intervals, and offer fulcrums to the black/white keys 1*a*/1*b*. When a user depresses the front end portions of the black and white keys 1*a*/1*b*, the front end portions are sunk toward the key bed 1*c*, and the rear portions are lifted. Thus, the black and white keys 1*a*/1*b* pitch up and down like a seesaw.

While any force is not exerted on the front end portions, the black and white keys 1*a*/1*b* stay at respective rest positions, and the black and white keys 1*a*/1*b* at the rest positions are drawn in solid lines in FIG. 1. The black and white keys 1*a*/1*b* are terminated at respective end positions, and the black and white keys 1*a*/1*b* at the end positions are drawn in dot-and-dash lines in FIG. 1. The keystroke is indicative of the distance from the rest positions. In this instance, the keystroke at the rest positions is zero, and the keystroke at the end positions is 10 millimeters. Thus, the keystroke is varied between zero and 10 millimeters. The rest position and end position are labeled with "R" and "E" in FIG. 2, and the distance between the rest position R and the end position E is 10 millimeters.

Turning back to FIG. 1, the black/white keys 1*a*/1*b* are respectively linked with the action units 2 so that depressed keys 1*a*/1*b* actuate the associated action units 2. The hammers 3 rest on jacks 2*a*, which form parts of the action units 2 together with regulating buttons 2*b*. When the toes of the jacks 2*a* are brought into contact with the associated regulating buttons 2*b*, the jacks 2*a* escape from the associated hammers 3, and exert force on the hammers 3. Then, the hammers 3 start free rotation toward the associated strings 4. Thus, the hammers 3 are driven for the free rotation through the escape of the jacks 2*a*.

The strings 4 are stretched over the associated hammers 3, and are struck with the associated hammers 3 at the end of the free rotation. The dampers 5 are linked with the rear end portions of the black and white keys 1*a*/1*b*, and are associated with the strings 4, respectively. While the black and white keys 1*a*/1*b* are staying at the rest positions, the dampers 5 are held in contact with the associated strings 4, and prevent the associated strings 4 from vibrations. The depressed keys 1*a*/1*b* make the associated dampers 5 spaced from the strings 4 on the way to the end positions. Then, the strings 4 get ready for vibrations.

Although the acoustic piano 100 further includes pedals, the pedals, i.e., the damper pedal, soft pedal and sostenuto pedal are well known to persons skilled in the art, and no further description is hereinafter incorporated.

System Configuration of Electronic System

The electronic system 200, which serves as the automatic player 210 and recorder 220, includes an array of solenoid-operated key actuators 6, a controller 8, an array of key sensors 25, an array of hammer sensors 26 and plunger sensors 35. The plunger sensors 35 are built in the solenoid-operated key actuators 6, respectively. The controller 8 is connected to the solenoid-operated key actuators 6, and selectively energizes the solenoid-operated key actuators 6 with driving signals ui. The solenoid-operated key actuators 6 give rise to the key motion without any fingering of a human player, and the plunger sensors 35 supply plunger velocity signals ym to the controller 8. The controller 8 is further connected to the key sensors 25, and the key sensors 25 supply key position signals yk to the controller 8. Similarly, the controller 8 is connected to the hammer sensors 26, and the hammer sensors 26 supply hammer position signals yh to the controller 8. Although the key sensors 25 are shared between the automatic player 210 and the recorder 220, the plunger sensors 35 and hammer sensors 26 respectively form parts of the automatic player 210 and parts of the recorder 220.

The solenoid-operated key actuators 6 are provided below the rear portions of the black and white keys 1*a*/1*b*, and are supported by the key bed 1*c*. A slot is formed in the key bed 1*c*, and laterally extends under the rear portions of the black and white keys 1*a*/1*b*. The solenoid-operated key actuators 6 have respective plungers 6*a*, and the plungers 6*a* are projectable from and retractable into yokes, which are associated with solenoids 6*b*. While the plungers 6*a* are resting in the yokes, the tips of plungers 6*a* are in the close proximity of the lower surfaces of the associated keys 1*a*/1*b*. When the solenoids 6*b* are energized with the driving signals ui, the plungers 6*a* project from the yokes, and upwardly push the rear portions of the black/white keys 1*a*/1*b*.

The plunger sensors 35 are of the MM type velocity sensor so that the plunger velocity is converted to the plunger velocity signals ym. The MM type velocity sensor is well known to persons skilled in the art so that no further description is hereinafter incorporated for the sake of simplicity. The plunger velocity signals ym are used in a servo control for the automatic playing as will be hereinlater described in detail.

The key sensors 25 are similar in constitution to one another. Each of the key sensors 25 raises the potential level of the key position signal ym at transit of reference points on the key trajectory. The transit-type key sensor 25 is so simple in constitution that the production cost is lower than that of a key sensor of the type continuously varying the output signal between the rest position and the end position. The transit-type key sensor 25 is, by way of example, implemented by a shutter plate 25*a* and a photo coupler 25*b*. The shutter plate 25*a* is attached to the lower surface of the black/white key 1*a*/1*b*, and the photo coupler 25*b* throws a light beam across the trajectory of the shutter plate 25*a*. When the shutter plate 25*a* reaches a reference point on the trajectory, the light beam is interrupted by the shutter plate 25*a* so that the key sensor 25 abruptly raises the potential level of the key position signal ym. However, transit-type key sensor keeps the key position signal the low level between the reference points. Although the transit-type key sensors 25 are economical, the transit-type key sensor 25 merely indicates the transit at the reference points, and it is impossible to use the transit-type key sensors 25 in a servo control loop.

In this instance, four reference points K1, K2, K3 are determined along the key trajectory between the rest position R and the end position E as shown in FIG. 2, and the distance between every two reference points is known. When the black and white key 1*a*/1*b* passes each of the reference points K1 to K4, the key sensor 25 raises the potential level of the position signal ym for a short time period.

The hammer sensors 26 are of the optical type, and the controller 8 calculates the time at which the hammers 3 are bought into collision with the strings 4 and the hammer velocity immediately before the collision.

The controller 8 is the origin of the data processing capability, and the system configuration of the controller 8 is shown in FIG. 3. The controller 8 includes a central processing unit 40, which is abbreviated as "CPU", a read only memory 41, which is abbreviated as "ROM", a random access memory 42, which is abbreviated as "RAM", an external memory unit 43, a signal interface 44, which is abbreviated as "I/O", a pulse width modulator 45, which is abbreviated as "PWM", and a shared bus system 46. The central processing unit 40, read only memory 41, random access memory 42, external memory unit 43, signal interface 44 and pulse width modulator 45 are connected to the shared bus system 46 so that the central processing unit 40 is communicable with the read only memory 41, random access memory 42, external memory unit 43, signal interface 44 and pulse width modulator 45 through the shared bus system 46. Although a communication interface and a MIDI interface are further connected to the shared bus system 46, these system components are not shown in the drawings. The controller 8 is connectable to the Internet through the communication interface and to another musical instrument through the MIDI interface. The MIDI interface is designed for MIDI music data codes, and the abbreviation MIDI means the "musical instrument digital interface" protocols.

The central processing unit 40 sequentially executes instruction codes expressing jobs, and the automatic playing and recording are carried out through the jobs. The instruction codes are stored in the read only memory 41 so that the central processing unit 40 sequentially fetches the instruction codes from the read only memory 41 through the shared bus system 46. Other fundamental data are also stored in the read only memory 41 so that the central processing unit 40 accesses the read only memory 41 in the data processing for the automatic playing and recording.

The random access memory 42 serves as a working memory. While the central processing unit 40 is executing the jobs, data codes, which express pieces of intermediate data, and music data codes, which express tones to be produced, are temporarily stored in the random access memory 42. Several tables are defined in the random access memory 42, and areas of each table are respectively assigned to the eighty-eight keys 1*a*/1*b*. Pieces of key position data, pieces of hammer position data and pieces of plunger velocity data are selectively written in the areas in the tables.

The external memory unit 43 has a data holding capacity much larger than that of the random access memory 42, and is, by way of example, implemented by a hard disk, a flexible disk such as a floppy disk (trademark), a CD (Compact Disk) such as a CD-ROM or CD-RAM, a MO (Magneto-Optical) disk, a zip, a DVD (Digital Versatile Disk) and/or a semiconductor memory board. The external memory unit 43 includes a driver for the above information storage medium. Data files, in which pieces of music are memorized, are stored in the external memory unit 43.

Analog-to-digital converters and data buffers are incorporated in the signal interface 44. Although a manipulating panel is further connected to the signal interface 44, the manipulating panel is not shown in FIG. 3. The plunger sensors 35, key sensors 25 and hammer sensors 26 are selectively connected to the analog-to-digital converters. The key position signals yk, hammer position signals yh and plunger velocity signals ym are periodically sampled, and the discrete values on the key position signals yk, discrete values on the plunger velocity signals ym and discrete values on the hammer position signals yh are converted to digital codes, which are referred to as "digital key position signals yd", "digital plunger velocity signals yvd" and "digital hammer position signals". The digital key position signals yd, digital plunger velocity signals yvd and digital hammer position signals are temporarily stored in the data buffers, and are fetched by the central processing unit 40. In this instance, the key position signals yk, hammer position signals yh and plunger velocity signal ym are sampled at regular intervals of 1 millisecond.

The pulse width modulator 45 is connected to the solenoids 6*b*, and is operative to adjust the driving signals ui to certain duty ratio. The central processing unit 40 informs the pulse width modulator 45 of the duty ratio for each of the solenoid-operated key actuators 6 associated with the black and white keys 1*a*/1*b* to be moved.

The shared bus system 46 includes data signal lines, address signal lines and control signal lines. Data codes such as, for example, music data codes and data codes expressing the duty ratio are propagated through the data signal lines, and address codes are supplied to the read only memory 41 and random access memory 42 through the address signal lines. Control signals such as, for example, an enable signal, a read-write signal, a select signal and a system clock signal are assigned to the control signal lines.

As described hereinbefore, the automatic playing and recording are carried out through the execution of instruction codes. The instruction codes form a computer program, and the computer program is broken down into a main routine program and subroutine programs. While the main routine program is running on the central processing unit 40, a user gives an instruction to the electric system 200 through the manipulating panel (not shown). When the central processing unit 40 acknowledges the instruction, the main routine program branches to the subroutine program corresponding to the instruction. One of the subroutine programs runs on the central processing unit 40 for the automatic playing, and another subroutine program runs for the recording. While the subroutine program is running on the central processing unit 40 for the automatic playing or recording, the subroutine program periodically branches to a subroutine program for data acquisition, and the pieces of key position data and pieces of plunger velocity data or the pieces of key position data and pieces of hammer position data are transferred from the signal interface 44 to the random access memory 42.

Turning black to FIG. 1, function blocks 10, 11 and 12 are representative of the subroutine program for the automatic playing, and are called as a "preliminary data processor", a "motion controller" and a "servo controller", respectively. On the other hand, the subroutine program for the recording is expressed by function blocks 28 and 29, which are called as a "music data producer" and a "post data processor", respectively.

A user is assumed to record his or her performance on the acoustic piano 100. While the user is fingering on the keyboard 1 for producing the acoustic piano tones along a music passage, the music data producer 28 memorizes the pieces of key position data and pieces of hammer position data so that these position data are accumulated in the memory locations in the tables assigned to the black and white keys 1*a*/1*b* and hammers 3. The music data producer 28 periodically analyzes the pieces of key position data and pieces of hammer position data for the key motion and hammer motion.

When the music data producer 28 notices a black/white key 1*a*/1*b* brought into a note-on event, the music data producer 28 determines the key number assigned to the depressed key 1*a*/1*b*, final hammer velocity and time at which the acoustic piano tone is to be produced, and produces a piece of music data representative of the note-on event. Similarly, when the music data producer 28 notices the black/white key 1*a*/1*b* brought into a note-off event, the music data producer 28 determines the key number and time at which the acoustic piano tone is to be decayed, and produces a piece of music data representative of the note-off event. Thus, the music data producer 28 repeats the above-described sequence for the depressed keys 1*a*/1*b* and released keys 1*a*/1*b*, and produces the pieces of music data expressing the performance on the acoustic piano 100.

The key sensors 25, hammer sensors 26 and acoustic piano 100 have their own individualities. For example, irregularity is found in the light intensity of the light beams thrown across the key trajectories and light-to-photo current converting characteristics of the key sensors/hammer sensors 25/26, and the gaps between the key bed 1*c* and the lower surfaces of the keys 1*a*/1*b* are not strictly equal to one another. The individualities are influential in the pieces of key position data and pieces of hammer position data so that the pieces of music data make another musical instrument produce the tones slightly different from the original piano tones. For this reason, the post data processor 29 eliminates the influence of the individualities from the pieces of position data so as to normalize the pieces of music data. The post data processor 29 memorizes the pieces of normalized music data in the MIDI music data codes.

The preliminary data processor 10, motion controller 11 and servo controller 12 behave in the automatic playing as follows. A user is assumed to instruct the electric system 200 to reenact a performance. The set of MIDI music data codes expressing the performance is transferred from a data source such as, for example, the external memory unit 43 to the random access memory 42, and the preliminary data processor 10 starts sequentially to process the pieces of music data memorized in the MIDI music data codes.

The preliminary data processor 10 searches the random access memory 42 to see whether or not there is found a MIDI music data code to be presently processed. When the preliminary data processor 10 finds the MIDI music data code or codes to be presently processed, the preliminary data processor 10 normalizes and converts the unit of the physical quantity in the pieces of music data. Thus, the preliminary data processor 10 firstly prepares a piece of playback data for the motion controller 11.

FIG. 4 shows a data format of the piece of playback data. The piece of playback data contains a piece of time data t, a piece of position data x, a piece of velocity data v and a piece of identification data Kn. The piece of identification data Kn expresses the key number Kn assigned to the black/white key 1*a*/1*b*.

The motion controller 11 processes the piece of playback data, and determines a reference key trajectory on which the black/white key 1*a*/1*b* is to travel. The motion controller 11 periodically supplies a target key position ru and a target key velocity rv to the servo controller 12. The servo controller 12 forces the black/white key 1*a*/1*b* to pass the target key position ru on the reference key trajectory at the target key velocity rv. If the black/white key 1*a*/1*b* exactly travels along the reference key trajectory, the black/white key 1*a*/1*b* gives rise to the hammer motion identical with the original hammer motion so that the acoustic piano tone is produced at the loudness equal to that of the original piano tone. As will be described hereinafter in detail, the servo controller 12 compares the target key position ru and target key velocity rv with the current key position and current key velocity, which are reported to the servo controller 12 through the key position signal yk and plunger velocity signal ym, to see whether or not the black/white key 1*a*/1*b* exactly travels on the reference key trajectory. When the answer is given affirmative, the servo controller 12 keeps the driving signal ui at the present value of the duty ratio. On the other hand, if the answer is given negative, the servo controller 12 regulates the driving signal ui to appropriate value of the duty ratio. The servo control sequence is described in Japanese Patent Application laid-open No. Hei 7-175471.

The servo controller 12 forces the black/white key 1*a*/1*b* to travel on the target key trajectory through the driving signal ui, and the black/white key 1*a*/1*b* makes the associated action unit 2 timely escape from the hammer 3. The hammer 3 is brought into collision with the string 4 at the target hammer velocity so that the acoustic piano tone is reproduced at the loudness equal to that of the original piano tone. The preliminary data processor 10, motion controller 11 and servo controller 12 repeat the above-described sequence, and reproduce the key motion same as that in the original performance.

The preliminary data processor 10, motion controller 11 and servo controller 12 can reproduce the stop-and-go key motion as well as the standard key motion.

Servo Control on Black and White Keys

Figure 5:
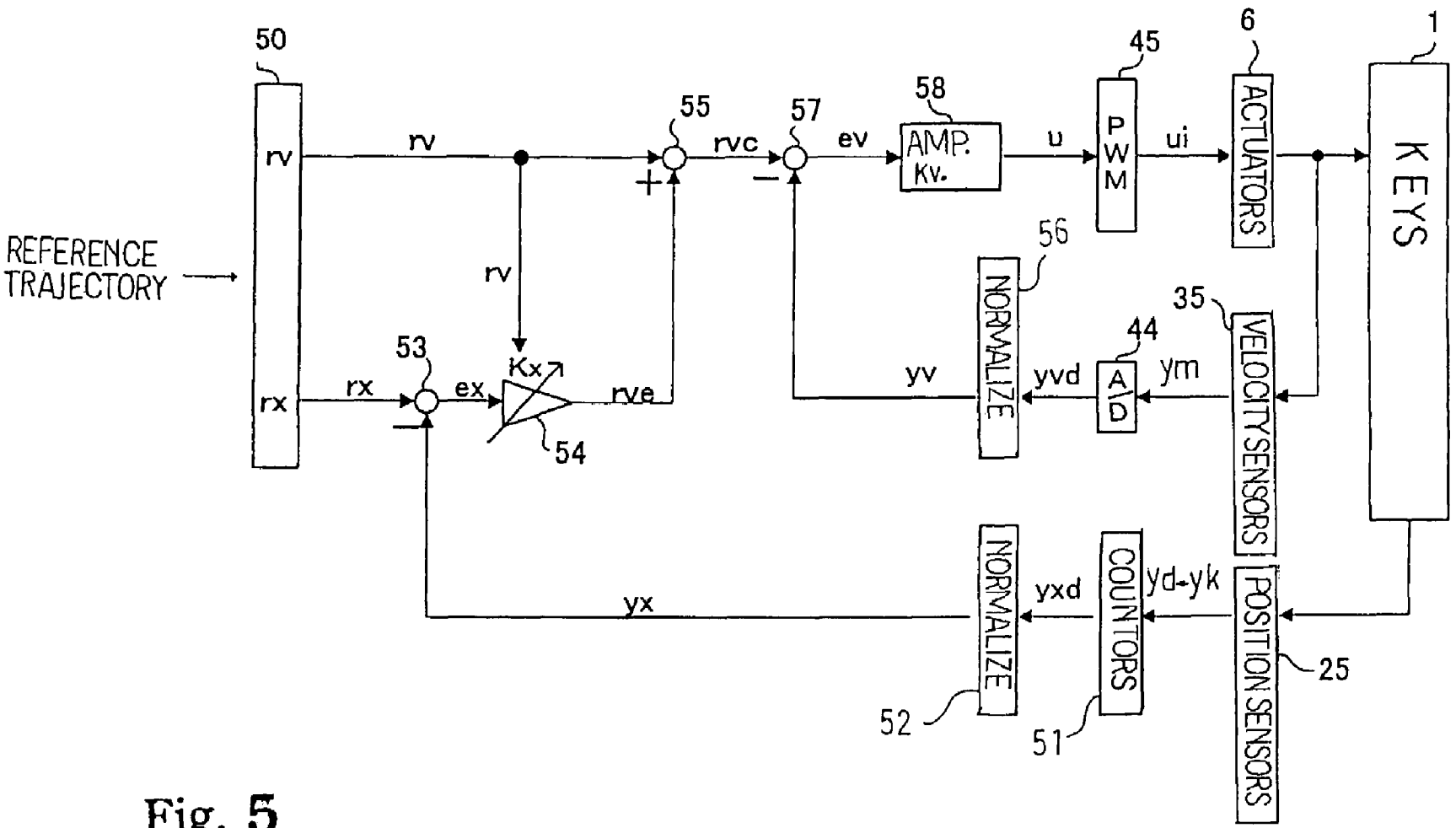
FIG. 5 is a block diagram showing functions of the controller in the automatic playing.

FIG. 5 shows the servo control loop for the black and white keys 1*a*/1*b*. Function blocks 1, 6, 25, 35, 44 and 45 stand for the black/white keys 1*a*/1*b*, solenoid-operated key actuators 6, key sensors 25, velocity sensors 35, signal interface 44 and pulse width modulator 45, respectively. Function blocks 50, 51, 52, 56 and 58, small circles 53, 55 and 57 and a triangle with an arrow 54 are realized through the subroutine program.

The function block 50 varies the target key position rx and target key velocity rv at regular intervals equal to the regular intervals for the sampling, i.e., 1 millisecond. Thus, the target key position rx and target key velocity rv are variable in synchronism with the sampling on the key position signal yk/yd and plunger velocity signal ym. The unit of the target key velocity rv is millimeter per second, and values of the target key position rx are indicative of the rest position R, reference points K1, K2, K3 and K4 and end position E. The target key position rx is usually maintained at a certain value corresponding to the rest position R, one of the reference points K1 to K4 or end position over plural sampling time periods.

Since the key sensors 25 are of the transit type, the potential level of the key position signal yk momentarily rises over a threshold at each of the reference points K1, K2, K3 and K4 on the actual key trajectory. When the potential level exceeds the threshold in the downward key motion, one-shot pulse is supplied to the counter 51 so as to increment the counter 51. On the other hand, the counter 51 is decremented by the one-shot pulse in the upward key motion. The "count-up" or "count-down" is determined on the basis of the direction of the plunger velocity, i.e., a positive value or a negative value. Thus, the counter 51 is indicative of the region of the actual key trajectory where the black/white key 1*a*/1*b* is presently found. The normalization is carried out as by the function block 52, and the normalized key position yx is supplied to the comparator 53. The normalization at the function block 52 will be hereinlater described.

On the other hand, the plunger velocity signal ym is indicative of the current plunger velocity, and the current plunger velocity is equal to the current key velocity. The plunger velocity signal ym is converted to the digital plunger velocity signal yvd through the analog-to-digital converter in the signal interface 44, and the piece of plunger velocity data is normalized for the unit conversion and elimination of offset between the designed position and the actual position of the plunger sensor 35 as by the function block 56. The normalized plunger velocity or normalized key velocity yv is supplied to the comparator 57.

The target key position rx and target key velocity rv are supplied to the comparator 53 and the variable-gain amplifier/adder 54/55 in parallel. The target key position rx is compared with the normalized key position yx so as to determine a positional deviation ex. The positional deviation ex is supplied to the variable-gain amplifier 54, and is multiplied by a variable gain Kx. The value of the variable gain Kx is varied in dependence on the target key velocity rv, and will be hereinlater described in detail. The product rve is supplied to the adder 55 so that the product rve is added to the target key velocity rv. The sum rvc is indicative of a modified target key velocity.

The modified target key velocity rvc is supplied to the comparator 57, and is compared with the normalized key velocity yv. The amplifier 58 multiplies the difference, i.e., a velocity deviation ev by a gain Kv, and the product u is supplied to the pulse width modulator 45. The product u is indicative of a target value of the duty ratio so that the pulse width modulator 45 adjusts the driving signal ui to the target value.

The driving signal ui is supplied to the solenoid-operated key actuator 6 so that the plunger 6*a* is accelerated or decelerated in the magnetic field. Since the plunger motion makes the associated black/white key 1*a*/1*b* moved on the trajectory, the plunger sensor 35 and key sensor 25 vary the plunger velocity signal ym and key position signal yk. Thus, the black and white keys 1*a*/1*b* are forced to travel on the reference trajectories through the servo control.

The variable gain Kx is determined as follows. In case where the target key velocity rv is not zero, i.e., rv≠0, the reference key trajectory is considered to express the continuous key motion, and the variable-gain amplifier 54 adjusts the variable gain Kx to zero.

On the other hand, if the target key velocity rv is zero between the rest position R and the end position E, the reference key trajectory is considered to express the stop-and-go key motion, and the variable-gain amplifier 54 adjusts the variable gain Kx to a certain value not equal to zero.

When the variable-gain amplifier 54 adjusts the variable gain Kx to zero in the continuous key motion, the product rve is equal to zero, and the sum or modified target key velocity rvc is equal to the target key velocity rv. For this reason, the comparison between the modified target key velocity rvc and the normalized key velocity yv is equivalent to the comparison between the target key velocity rv and the normalized key velocity yv. The pulse width modulator 45 adjusts the driving signal ui to a target duty ratio, which makes the velocity deviation ev, i.e., the difference between the target key velocity rv and the normalized key velocity yv reduced to zero.

On the other hand, when the variable-gain amplifier 54 adjusts the variable gain Kx to the certain value, the positional deviation ex is multiplied by the certain value, and the product rve is added to the target key velocity rv. However, the target key velocity rv is zero. The multiplied positional deviation rve serves as the modified target velocity rvc, and is compared with the normalized key velocity yv.

Figure 6:
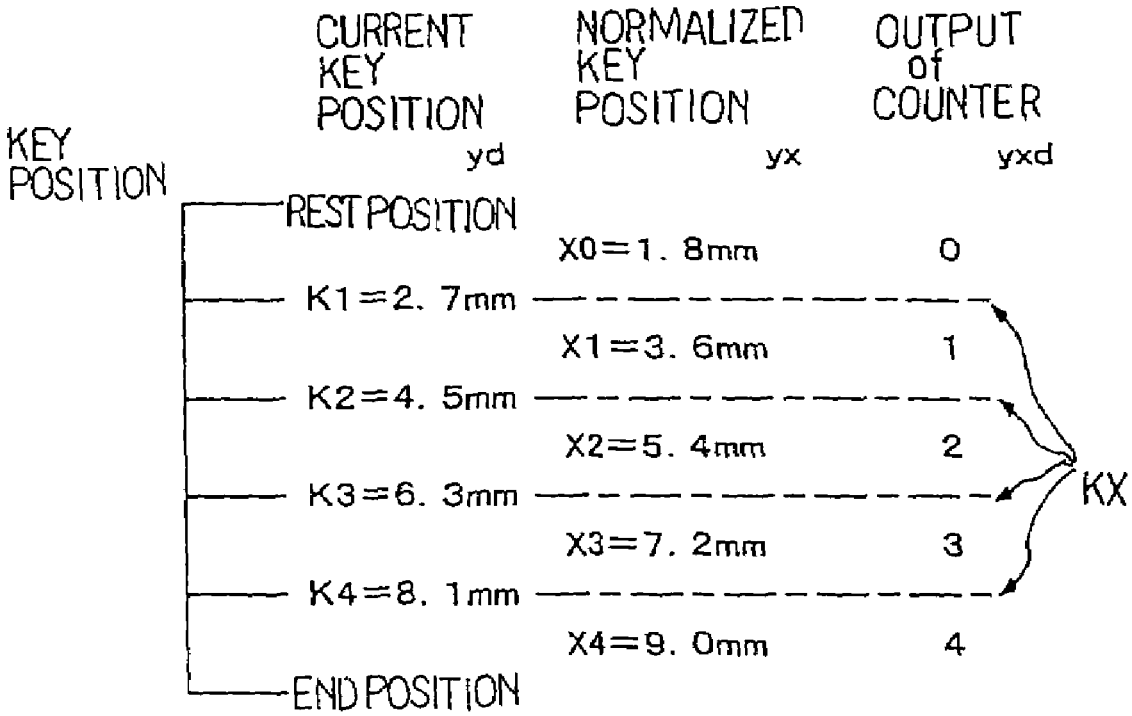
FIG. 6 is a view showing normalization on an output of a counter.

FIG. 6 shows a relation among the current key position yd, output yxd of the counter 51 and normalized key position yx. The relation is stored in the read only memory 41 in the form of a table. In this instance, the reference points K1, K2, K3 and K4 are found at 2.7 millimeters, 4.5 millimeters, 6.3 millimeters and 8.1 millimeters, which are measured from the rest position R. When the black/white key 1*a*/1*b* passes the reference points K1 to K4, the counter 51 changes the output yxd between zero and 4, and the current key position is normalized to 1.8 millimeters, 3.6 millimeters, 5.4 millimeters, 7.2 millimeters and 9.0 millimeters. In detail, while the black/white key 1*a*/1*b* is traveling between the rest position R and the reference point K1, between the reference point K1 and the reference point K2, between the reference point K2 and the reference point K3, between the reference point K4 and the end position E, the normalized key position yx is maintained at 0.18 millimeters, 3.6 millimeters, 5.4 millimeters, 7.2 millimeters and 9.0 millimeters, respectively. For example, even if a black/white is found at the rest position R, the current key position is normalized at 1.8 millimeters. Thus, the normalized key position yx is deviated from the associated reference points by ±0.9 millimeter.

Method for Servo Control on Keys

Figure 7:
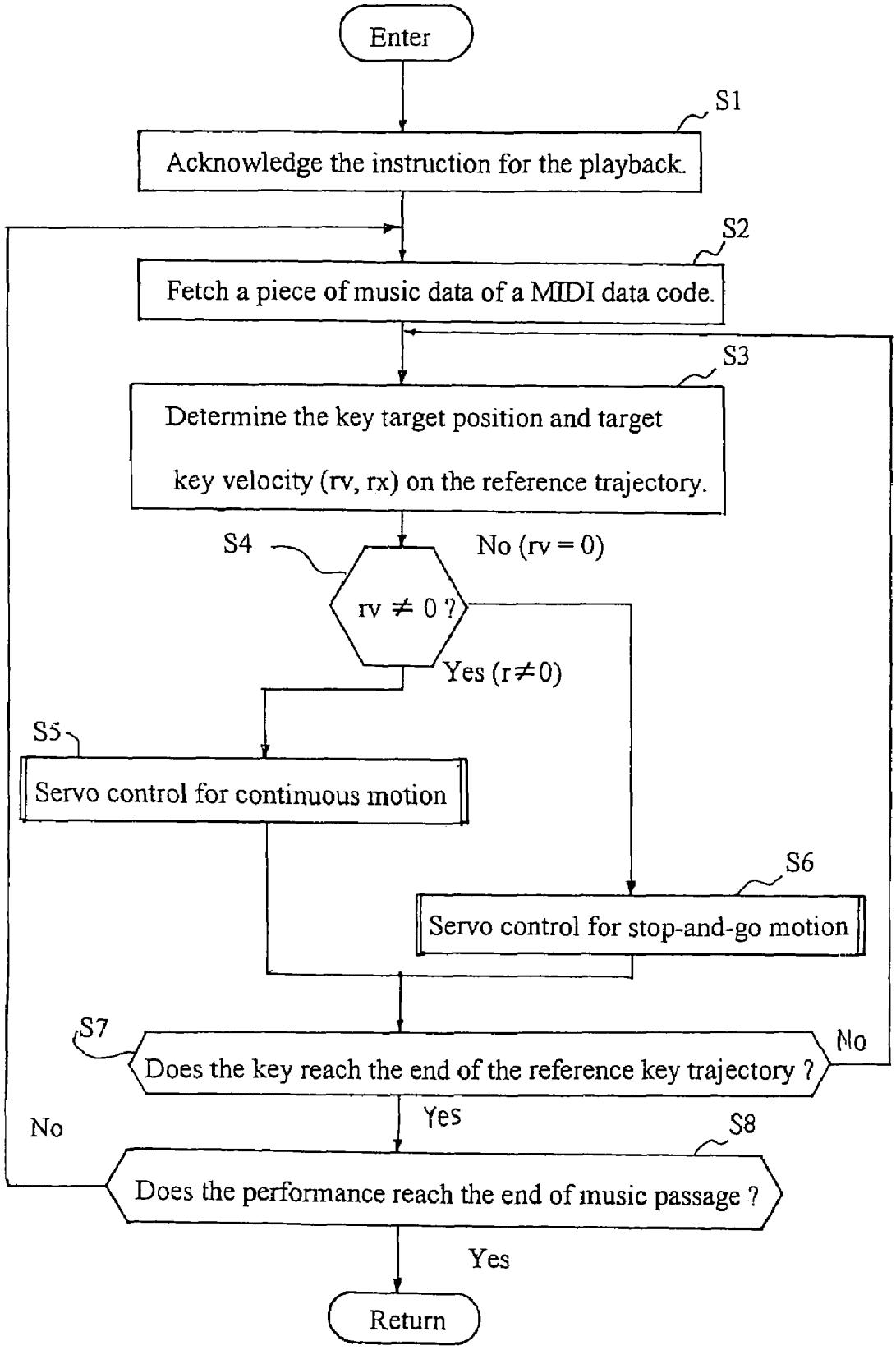
FIG. 7 is a flowchart showing a servo control on the keys in the automatic playing.

FIG. 7 shows an instruction sequence for the servo control on the black and white keys 1*a*/1*b* in the automatic playing. While the central processing unit 40 is reiterating the main routine, a user is assumed to instruct the electric system 200 to reenact a performance. The main routine program branches to the subroutine program for the automatic playing.

In detail, the central processing unit 40 acknowledges the instruction for the playback as by step S1. A set of MIDI music data codes is transferred to the random access memory 42, and a software timer starts to measure the lapse of time.

The central processing unit 40 checks the random access memory 42 for a piece of music data to be presently processed. When the central processing unit 40 finds a piece of music data expressing the note-on event, the central processing unit 40 fetches the MIDI music data code from the random access memory 42 as by step S2, and determines the reference key trajectory for the black/white key 1*a*/1*b* assigned the key number Kn identical with that of the MIDI music data code. The method of determining the reference key trajectory is disclosed in Japanese Patent Application laid-open No. Hei 7-175471 so that detailed description is omitted for the sake of simplicity.

The reference trajectory is a series of values of the target key position varied with time. The central processing unit 40 determines a present value of the target key position rx and a value of the target key velocity rv, which is calculated on the basis of the several values of the target key position rx, as by step S3.

When the present values rx and rv are determined, the central processing unit 40 compares the present vale rv with zero to see whether or not the black/white key 1*a*/1*b* is to be stopped on the reference key trajectory as by step S4.

The target key velocity rv has a positive value immediately after the initiation of the downward key motion, and the answer at step S4 is given affirmative "Yes". With the positive answer "Yes", the central processing unit 40 proceeds to step S5 for the servo control for the continuous motion. The servo control for the continuous motion will be hereinlater described in detail.

Subsequently, the central processing unit 40 checks the reference key trajectory to see whether or not the black/white key 1*a*/1*b* reaches the end of the reference key trajectory as by step S7. The answer at step S7 is given negative "No" until the last value of the target key position rx. With the negative answer "No", the central processing unit 40 returns to step S3, and determines the next value of the target key position rx and the next value of the target key velocity rv. Thus, the central processing unit 40 reiterates the loop consisting of steps S3, S4, S5/S6 and S7 on the way to the end of the reference key trajectory.

While the central processing unit 40 is reiterating the loop, the central processing unit 40 periodically checks the target key velocity rv to see whether or not the black/white key 1*a*/1*b* is to be stopped on the reference key trajectory. If the answer at step S4 is given affirmative "Yes" at all the values of the target key position rx on the reference key trajectory, the key motion is categorized in the continuous key motion, and the central processing unit 40 takes the path from step S4 to step S5 at all times.

When the black/white key 1*a*/1*b* is terminated at the end of the reference key trajectory, the answer at step S7 is given affirmative "Yes", and the central processing unit 40 checks the set of music data codes to see whether or not the performance reaches the end of the music passage as by step S8. If the central processing unit 40 finds a MIDI music data code expressing another note-on event, the central processing unit 40 returns to step S2, and reiterates the loop consisting of steps S2 to S8, and controls the solenoid-operated key actuators 6 for producing the acoustic piano tones along the music passage. When the automatic playing reaches the end of the music passage, the answer at step S8 is given affirmative "Yes", and the central processing unit 40 returns to the main routine.

The reference key trajectory is assumed to express the stop-and-go key motion. The target key velocity rv is changed to zero at a certain target key position rx on the reference key trajectory, and the answer at step S4 is given negative "No". The certain target key position rx is equal to one of the reference points K1 to K4 closest to the certain target key position rx. Then, the central processing unit S6 proceeds to step S6, and controls the black/white key 1*a*/1*b* for the stop-and-go motion. The control sequence for the stop-and-go motion will be hereinlater described in detail.

Upon completion of step S6, the central processing unit 40 proceeds to step S7, and reiterates the loop consisting of steps S3 to S7. When the black/white key 1*a*/1*b* reaches the end of the reference key trajectory, the central processing unit 40 proceeds to step S8. Thus, the central processing unit 40 reiterates the loop consisting of steps S2 to S8 for the automatic playing.

Figure 8A:
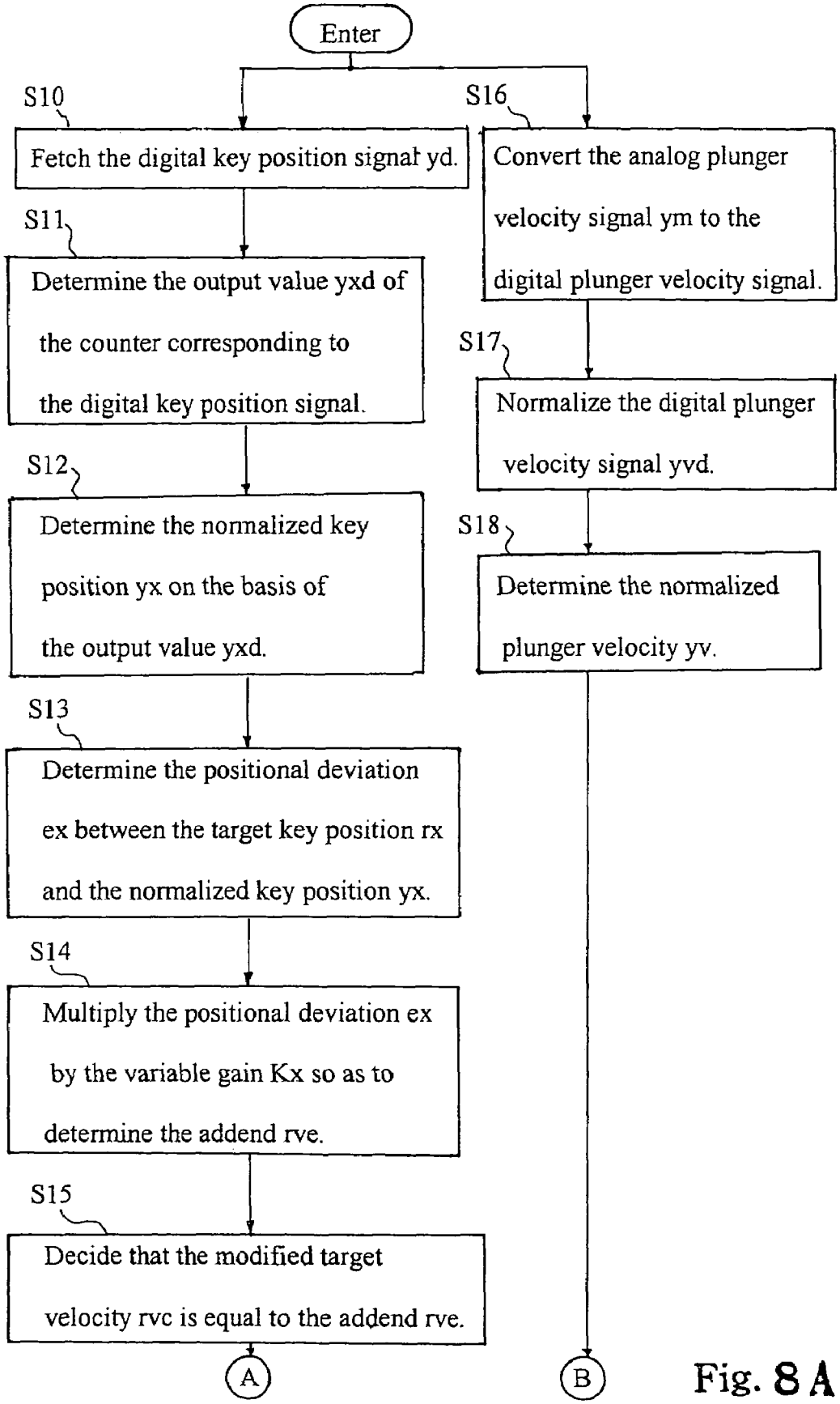
FIGS. 8A and 8B are flowcharts showing a servo control for stop-and-go motion.
Figure 8B:
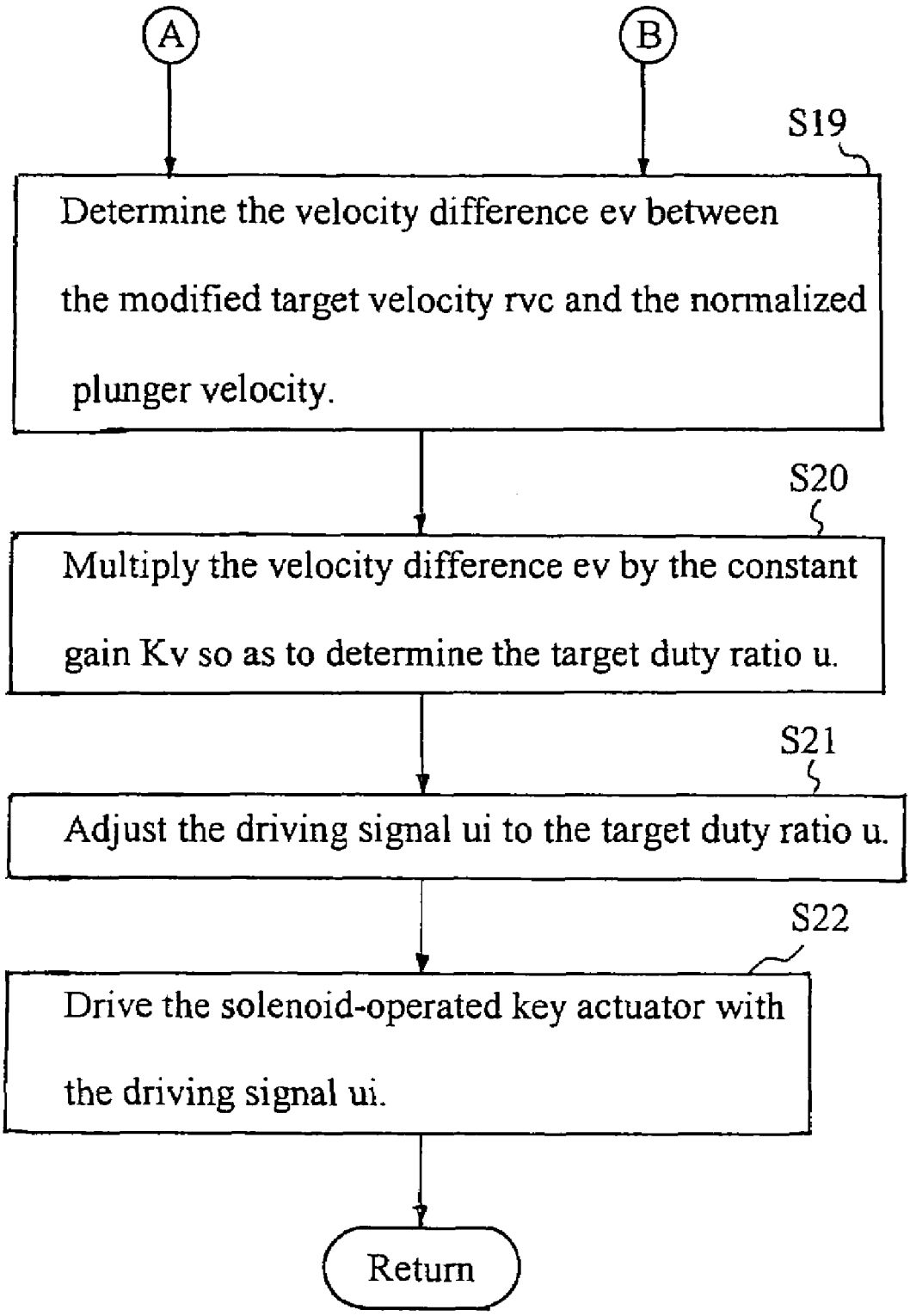
Figure 8C:
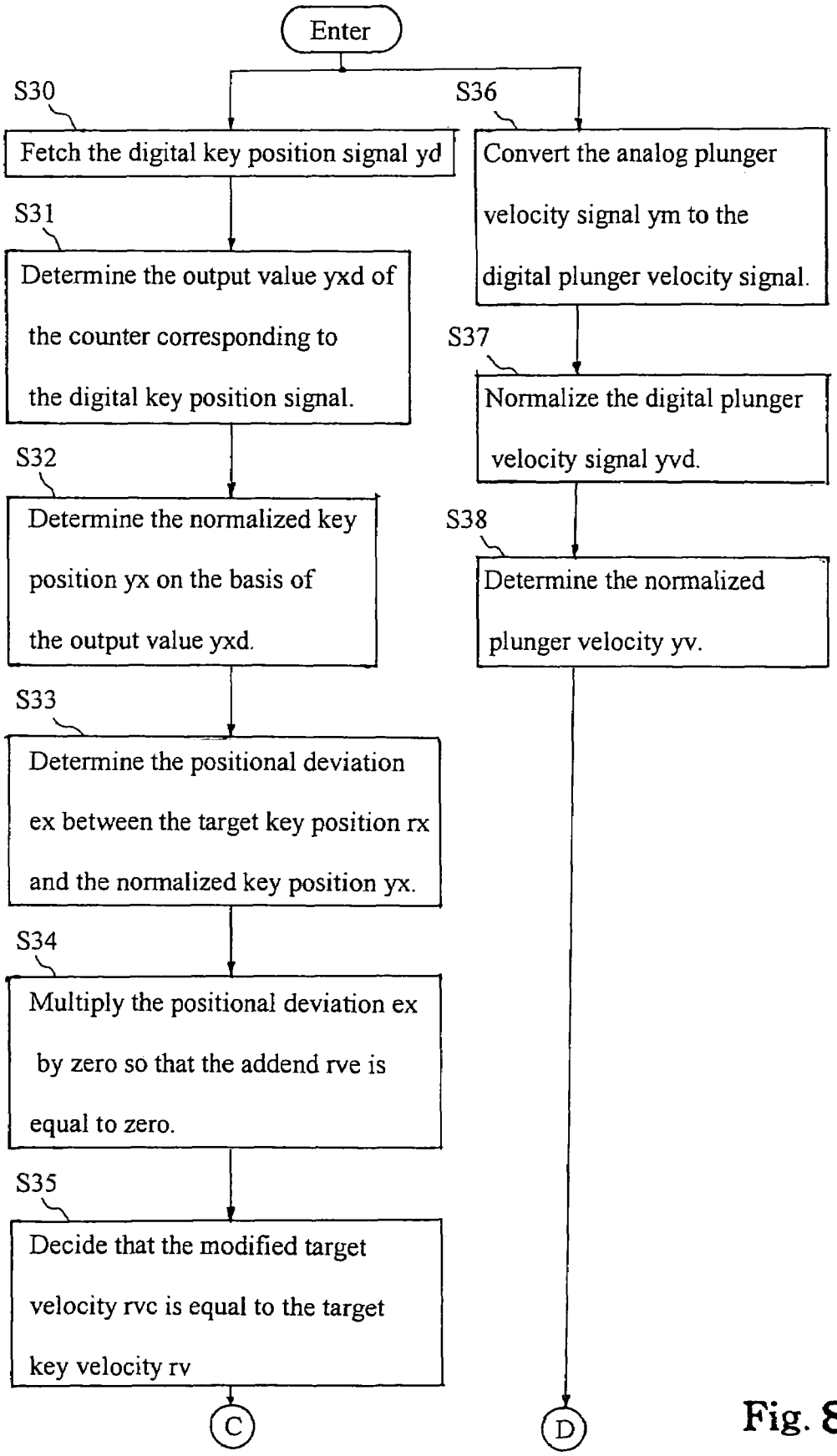
FIGS. 8C and 8D are flowcharts showing a servo control for continuous motion.
Figure 8D:
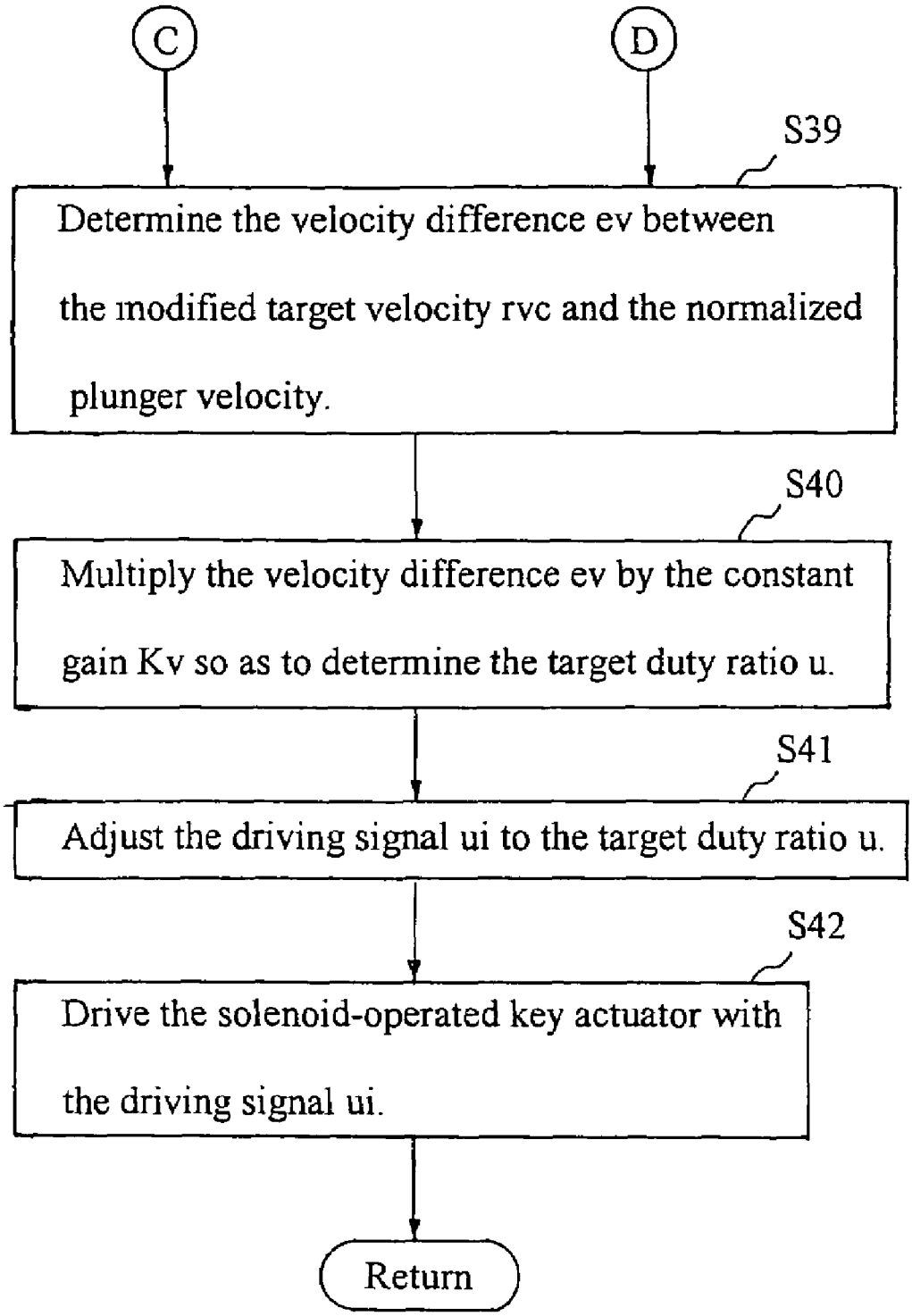

FIGS. 8A and 8B show the servo control for the stop-and-go motion, and FIGS. 8C and 8D show the control for the continuous motion. The flowcharts have parallel paths as shown in FIGS. 8A/8B and 8C/8D, and the controller 8 achieves the tasks through a parallel processing.

First, description is made on the stop-and-go key motion. There are two paths in the flowchart shown in FIGS. 8A and 8B. The first path starts at step S10, and continues on step S19. The second path starts at step S16, and also continues on step S19. The target key position rx is indicative of one of the reference points K1, K2, K3 and K4, and the target key velocity rv is zero at the reference point K1, K2, K3 or K4. The reference point K1, K2, K3 or k4 at which the black/white key 1*a*/1*b* is to be stopped is hereinafter referred to as the "target stop KX".

In detail, the central processing unit 40 fetches the digital key position signal yd at step S10, Subsequently, the central processing unit 40 determines the output value yxd of the counter 51 indicative of the region on the actual key trajectory as by step S11, and the output value yxd is normalized to the normalized key position yx with reference to the relation shown in FIG. 6 as by step S12.

The central processing unit 40 compares the normalized key position yx with the target key position rx, and determines the positional deviation ex between the normalized key position yx and the target key position rx as by step S13. The normalized key position yx is spaced from the target stop KX by ±0.9 millimeter so that the positional deviation ex is either −0.9 millimeter or +0.9 millimeter until the time at which the black/white key 1*a*/1*b* to restart. Subsequently, the central processing unit 40 multiplies the positional deviation ex by the variable gain Kx, and determines the product rve to be the addend as by step S14.

The central processing unit 40 adds the addend rve to the target velocity rv, and determines the modified target velocity rvc as by step S115. As already described, the target key velocity rv is zero so that the modified target velocity rvc is equal to the addend rve. Thus, the positional deviation ex is converted to the modified target velocity rvc through the multiplication at the amplifier 54.

The second path proceeds as follows. First, the controller 8 converts the analog plunger velocity signal ym to the digital plunger velocity signal yvd as by step S16, and the central processing unit 40 normalizes the current plunger velocity expressed by the digital plunger velocity signal yvd as by step S17 so as to proceed to step S19 with the normalized key velocity yv as by step S118.

When both of the modified target velocity rvc and normalized key velocity yv are determined, the central processing unit 40 determines the velocity difference ev between the modified target velocity rvc and the normalized key velocity yv as by step S19.

Subsequently, the central processing unit 40 multiplies the velocity difference ev by the constant gain Kv so as to convert the velocity difference ev to the target duty ratio u. The central processing unit 40 requests the pulse width modulator 45 to adjust the driving signal ui to the target duty ratio u, and the pulse width modulator 45 responds to the request as by step S21.

Finally, the controller 8 supplies the driving signal ui to the solenoid-operated key actuator 6 under the black/white key 1*a*/1*b* as by step S22, and the central processing unit 40 proceeds to step S7.

As will be understood, if the black/white key 1*a*/1*b* has passed the target stop KX, the positional deviation ex is +0.9 millimeter; when the black/white key 1*a*/1*b* is found before the target stop KX, the positional deviation is −0.9 millimeter. The negative positional deviation ex or positive positional deviation keeps the black/white key 1*a*/1*b* in the vicinity of the target stop KX.

Next, description is made on the continuous key motion at step S5. In the continuous key motion, the target key velocity rv is not zero, and the flowchart for the continuous key motion also has two paths as shown in FIGS. 8C and 8D. The first path starts at step S30, and continues on step S39. The second path starts at step S36, and also continues on step S39.

The jobs at steps S30 to S33 are analogous to the jobs at steps S10 to S13, and the jobs at steps S36 to S42 are analogous to the steps at S16 to S22 except for the determination of the modified target velocity rvc. Since the variable gain Kx is zero for the target velocity rv not equal to zero, the addend rve is zero, and the modified target velocity rvc is equal to the target velocity rv. As a result, the normalized key velocity yv is directly compared with the target key velocity rv. Thus, the black and white keys 1*a*/1*b* are moved through the standard velocity servo control.

Figure 9A:
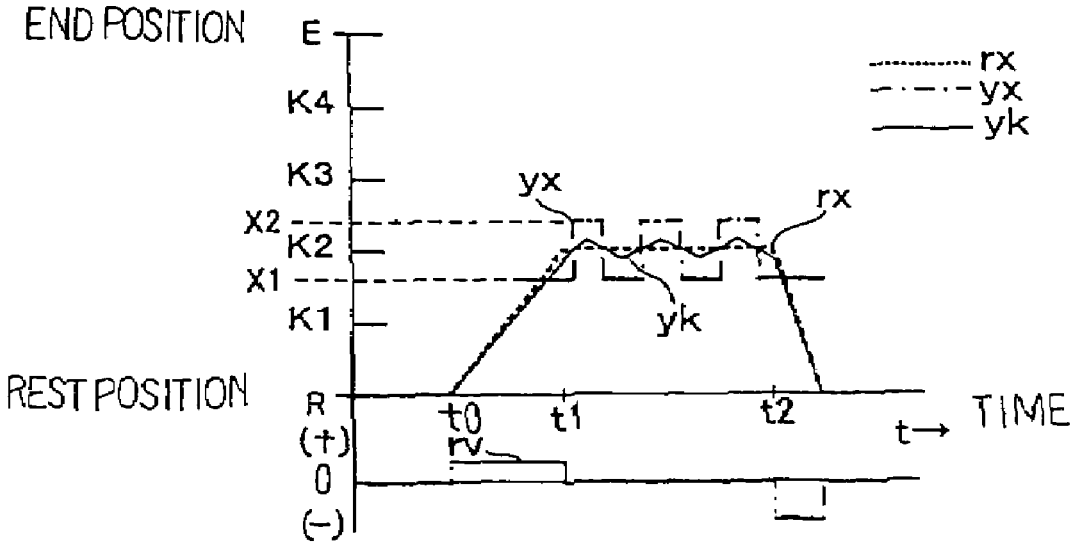
FIG. 9A is a graph showing the servo control for stop-and-go key motion achieved by the musical instrument of the present invention.

FIG. 9A shows the reference key trajectory and actual key trajectory obtained through the servo control for the stop-and-go key motion. A series of values of the key position signal yk stands for the actual key trajectory, and the series of values of the target key position rx expresses the reference key trajectory.

The target stop KX was specified at the reference point K2, which is spaced from the rest position R by 4.5 millimeters. The reference key trajectory was determined at time t0, and the servo control for the stop-and-go motion started with the positive value of target key position rx and the positive value of target key velocity rv. The black/white key 1*a*/1*b* took the continuous motion, and the key stroke was increased toward the reference point K2. The normalized key position was fixed to X1 until the region between the reference point K1 and the reference point K2.

The controller 8 fixed the target key velocity rv and target key position rx to zero and K2 at time t1 in order to keep the black/white key 1*a*/1*b* at the target stop KX or reference point K2. When the black/white key 1*a*/1*b* exceeded the reference point K2, the normalized key position yx was changed to X2 so that the black/white key 1*a*/1*b* was downwardly forced toward the target stop KX. On the other hand, when the black/white key 1*a*/1*b* entered the region blow the target stop KX, the normalized key position yx was changed to X1 so that the black/white key 1*a*/1*b* was upwardly forced toward the target stop KX. The normalized key position yx was changed from X1 to X2 and vice versa between time t1 and time t2, and the target key position rx and target key velocity rv were fixed to K2 and zero also between time t1 and time t2. Thus, the controller 8 kept the black/white key 1*a*/1*b* in the vicinity of the target stop KX.

As seen in FIG. 9A, the actual key position yk was slightly waved within the narrow range between X1 and X2. However, the waved range was negligible. Thus, the controller 8 stopped the black/white key 1*a*/1*b* at the target stop KX.

The controller 8 restarted the target key velocity rv and target key position rx varied with time at time t2 so that the black/white key 1*a*/1*b* returned to the rest position R.

Figure 9B:
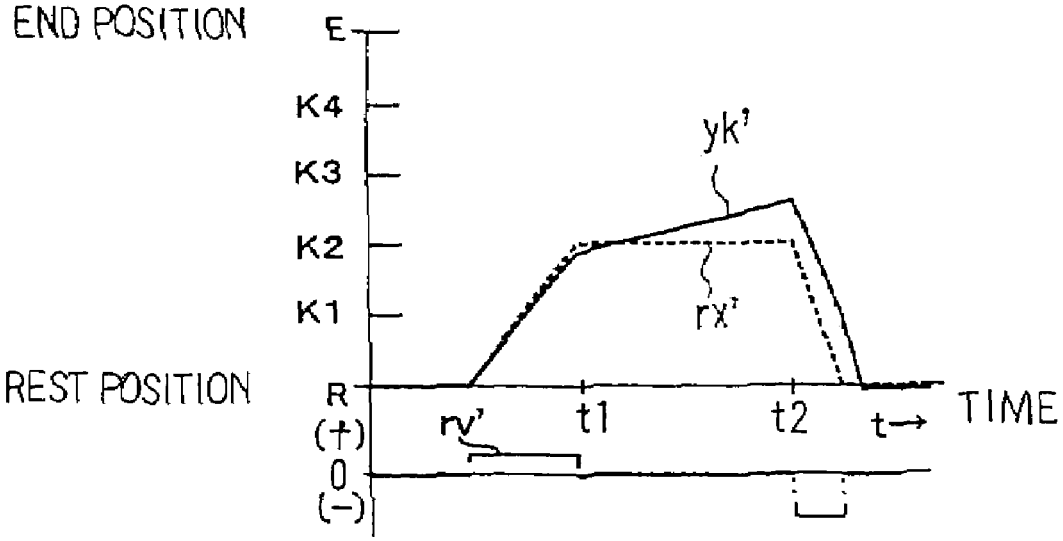
Fig. 9 B PRIOR ART
FIG. 9B is a graph showing the prior art serve control for the stop-and-go key motion.

FIG. 9B shows the reference key trajectory rx' and actual key trajectory yk' under the control of the prior art servo control technique described in conjunction with the related art. The prior art servo control loop was different from the servo control loop shown in FIG. 5 at the followings. First, the normalization shown in FIG. 6 is not carried out in the prior art servo control loop. Second, the actual key position, which is not normalized, and actual key velocity are respectively directly compared with the target key position and target key velocity so as to determine the positional deviation and velocity deviation, independently. The positional deviation and velocity deviation are respectively amplified or multiplied, and the products are added to each other. The sum is indicative of the duty ratio of the driving signal.

As shown in FIG. 9B, although the target key velocity rv' and target key position rx' were fixed to zero and K2 between time t1 and time t2, the black/white key 1*a*/1*b* was still moved toward the end position due to the current key position and current key velocity varied due to fluctuation of the dark current and offset voltage of the amplifier coupled to the key sensor.

As will be appreciated from the foregoing description, the controller 8 changes the normalized key position between the value Xn, which is less than the target stop, and the value Xn+1, which is greater than the target stop, depending upon the current key position on the actual key trajectory so that the solenoid-operated key actuators 6 exert the force opposite in direction to the key motion on the black/white keys 1*a*/1*b*. The black and white keys 1*a*/1*b* are forced to stay in the narrow region on both sides of the target stop KX. As a result, the controller 8 realizes the stop-and-go key motion.

Second Embodiment

Figure 10:
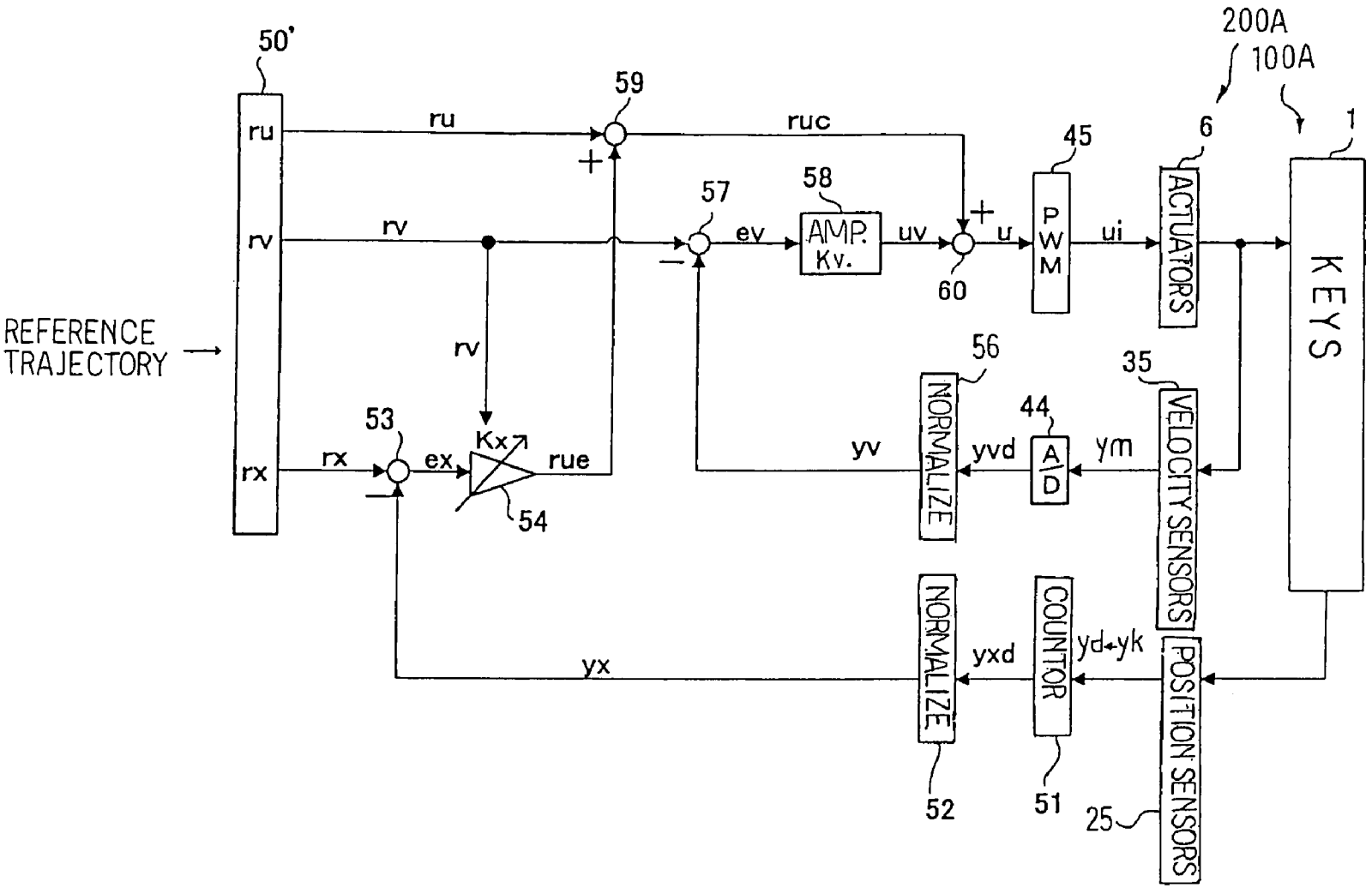
FIG. 10 is a block diagram showing functions of another controller in the automatic playing.

FIG. 10 shows a servo control loop employed in another automatic player piano. The automatic player piano largely comprises an acoustic piano 100A and an electric system 200A. The acoustic piano 100A is similar in structure to the acoustic piano 100, and component parts of the acoustic piano 100A are labeled with references designating the corresponding component parts of the acoustic piano 100 without detailed description.

The electric system 200A form a servo control loop for the black/white keys 1*a*/1*b*. Although the servo control loop shown in FIG. 10 is analogous to the servo control loop shown in FIG. 5, the function block 50 and adder 55 are respectively replaced with a function block 50' and an adder 59, and another adder 60 is connected between the amplifier 58 and the pulse width modulator 45.

The function block 50' supplies a constant ru representative of a bias current to the adder 59. The manufacturer may determine the magnitude of the bias current in consideration of the loss of the thrust due to the friction against the plunger motion, by way of example. The constant ru is added to the addend rue. The sum (ru+rue) is supplied to the adder 60 as a modified bias component ruc. On the other hand, the target key velocity rv is directly compared with the actual key velocity yv, and the difference is supplied to the amplifier 58 as the velocity deviation ev. The velocity difference ev is multiplied by the constant gain Kv, and the product uv is supplied to the adder 60. The product uv is added to the modified bias component ruc, and the sum is supplied to the pulse width modulator 45 as a target duty ratio of the driving signal ui.

When the target key velocity rv is changed to zero on the reference key trajectory, the electric system 200A reproduces the stop-and-go key motion through the servo control loop. In the servo control, the positional deviation ex is multiplied by the variable gain Kx, which is not equal to zero, and the product rue is added to the constant ru, and the sum is supplied to the adder 60 as the modified bias component ruc. Since the output of the counter 51 is normalized as similar to that of the servo control loop shown in FIG. 6, the black and white keys 1*a*/1*b* of the keyboard 1 are delicately waved around the target stop, and the users see the black and white keys 1*a*/1*b* as if they keep themselves at the target stop.

On the other hand, when function block 50' keeps the target key velocity rv to be not equal to zero, the electric system 200A reproduces the continuous key motion. The variable gain Kx is zero so that the multiplication results in zero. The constant ru is supplied to the adder 60 as the modified bias component ruc. Thus, the influence of the positional difference ex is eliminated from the duty ratio of the driving signal ui.

As will be understood, the automatic player piano implementing the second embodiment reproduces the stop-and-go key motion in the automatic playing.

Third Embodiment

Figure 11:
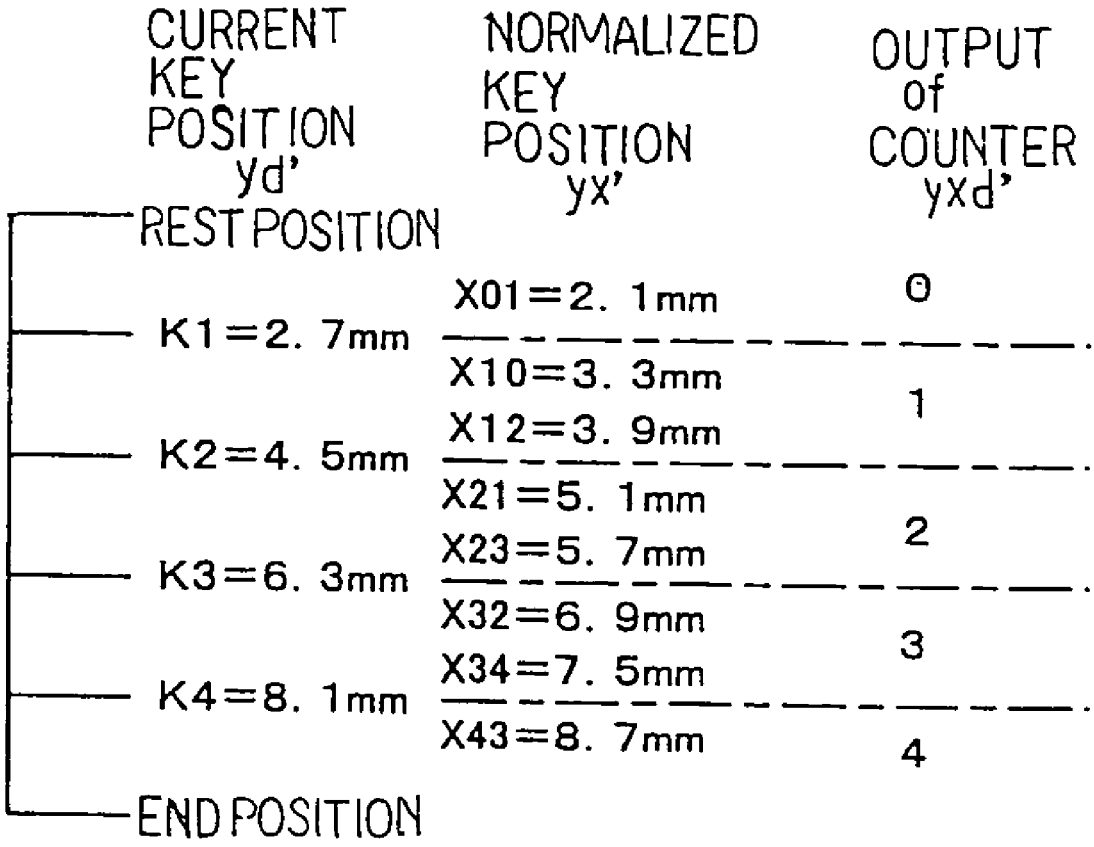
FIG. 11 is a view showing a concept of normalization on an output of a counter incorporated in yet another controller according to the present invention.

FIG. 11 shows a relation among a current key position yd', an output yxd' of a counter and a normalized key position yx' stored in a controller incorporated in an electric system for an automatic player piano embodying the present invention.

The automatic player piano implementing the third embodiment also comprises an acoustic piano and the electric system. The acoustic piano is similar in structure to the acoustic piano 100, and the electric system has a system configuration similar to that of the electric system 200. For this reason, description on the acoustic piano and system configuration is omitted for the sake of simplicity.

As seen in FIG. 11, the reference points K1, K2, K3 and K4 are determined at the same values of the keystroke, respectively, and the output yxd' is varied between zero and 4. However, the normalized key position yx' is correlated with the output yxd' of the counter differently from the normalized key position yx.

In detail, when the output yxd' is zero, the current key position yd' is normalized to be 2.1 millimeters. Two normalized key positions X10 and X12 are assigned to the region corresponding to the output yxd' of 1, and X10 and X12 are equal to the keystroke of 3.3 millimeters and 3.9 millimeters, respectively. Similarly, two normalized key positions X21 and X23 are assigned to the region corresponding to the output yxd' of 2, and X21 and X23 are equal to the keystroke of 5.1 millimeters and 5.7 millimeters, respectively. Two normalized key positions X32 and X34 are assigned to the region corresponding to the output yxd' of 3, and X32 and X34 are equal to the keystroke of 6.9 millimeters and 7.5 millimeters, respectively. However, only one normalized key position X43 is assigned to the region corresponding to the output yxd' of 4, and X43 is equal to the keystroke of 8.7 millimeters.

The two normalized key position X10/X12, X21/X23, X32/X34 of each region is selectively supplied to the comparator 53. When the black/white key 1a/1b exceeds the reference point K1, K2 or K3 from the region corresponding to the output yxd' of 0, 1 or 2 to the region corresponding to the output yxd' of 1, 2 or 3, the normalized key position X10, X21 or X32 is supplied to the comparator 53. On the other hand, when the black/white key 1a/1b exceeds the reference point K4, K3 or K2 from the region corresponding to the output yxd' of 4, 3 or 2 to the region corresponding to the output yxd' of 3, 2 or 1, the normalized key position X34, X23 or X12 is supplied to the comparator 53.

The double normalized key positions X10/X12, X21/X23 and X32/X34 are desirable from the view point that the servo control loop makes the black and white key 1a/1b confined in a narrower range around the target stop. Since the distance between the normalized key position yxd' and the target stop KX is less than the distance between the normalized key position yxd and the target stop KX, the force against the key motion is smaller than the force exerted on the black and white keys 1a/1b in the first embodiment so that the black and white keys 1a/1b are less waved.

As will be appreciated from the foregoing description, the current key position yd/yd' is normalized to a value different from that of the target stop KX in the time period to keep the black/white key at the target stop. The servo control loop exerts the counter force on the plunger, which exceeds the target stop so that the black and white keys appear to stop at the target stop. While the servo control loop is reproducing the continuous key motion, the positional deviation between the normalized key position and the target key position is minimized to zero, and the black and white keys 1a/1b are forced to travel on the reference key trajectories through the velocity servo control. Thus, the electric system can reproduce not only the continuous key motion but also the stop-and-go key motion.

While the black and white keys 1a/1b are traveling in the regions before the target stops, the plungers forwardly force the black/white keys 1a/1b to advance toward the target stop at all times. Even if the black and white keys 1a/1b momentarily exceed the target key positions, the servo control loop does not brake the black and white keys 1a/1b in so far as the current key positions are before the target stops. However, the prior art servo control loop accelerates and decelerates the black and white keys depending upon the relative relation between the current key positions and the target key positions on the entire key trajectories. When the noise component, which is due to the fluctuation of dark current, is unintentionally varied, the prior art servo control is made turbulent by the noise component. On the other hand, the servo control loop takes up the noise component through the normalization, and is free from the fluctuation of the dark current.

Fourth Embodiment

Figure 12:
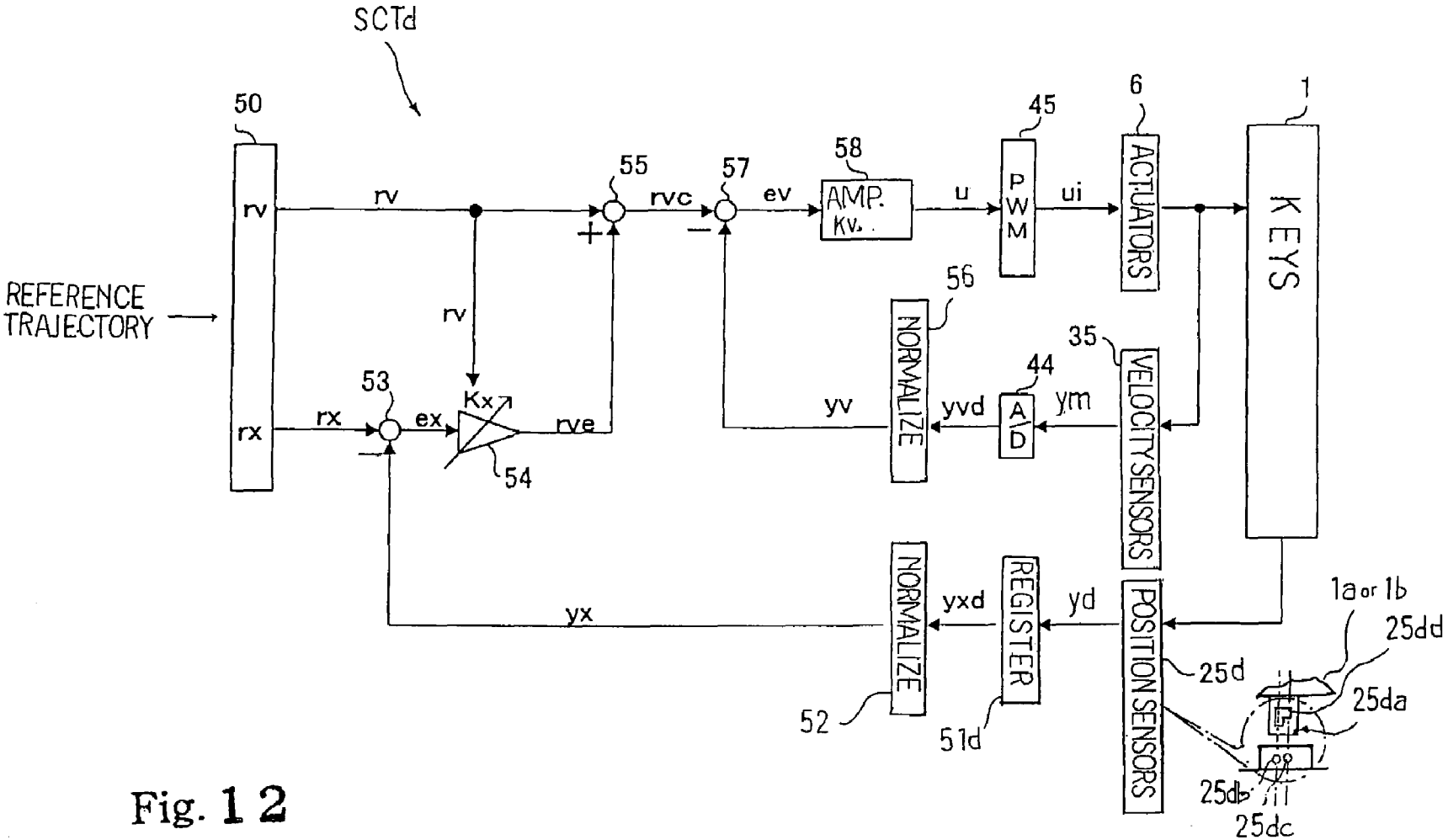
FIG. 12 is a block diagram showing functions of yet another controller in the automatic playing.

Turning to FIG. 12, a servo control loop SCTd is incorporated in still another automatic player piano embodying the present invention. The automatic player piano implementing the fourth embodiment also comprises an acoustic piano and an electric system which are similar to those of the first embodiment except for key position sensors 25d and register 51d. For this reason, description is focused on these different component parts 25d and 51d, and other component parts are labeled with references designating corresponding component parts of the first embodiment without detailed description.

Each of the key position sensors 25d includes a shutter plate 25da and plural photo-couplers 25db and 25dc. The shutter plate 25da is secured to the lower surface of the associated black/white key 1a/1b, and is moved together with the associated black/white key 1a/1b. The shutter plate 25da is formed with a window 25dd. The window 25dd has a left portion and a right portion, and the left portion is longer than the right portion. The left photo-coupler 25db is aligned with a trajectory of the left portion, and the right photo-coupler 25dc is aligned with a trajectory of the right portion.

While the black/white key 1a/1b is staying at the rest position, the shutter plate 25da permits both photo-couplers 25db and 25dc to throw light beams across the trajectory. When the black/white key 1a/1b reaches the first reference point K1, both light beams are interrupted with the shutter plate 25da. When the black/white key 1a/1b proceeds to the second reference point K2, the left photo-coupler 25db throws the light beam across the trajectory, again, and the right light beam is still interrupted. The shutter plate 25da at the third reference point K3 permits both light beams to pass the window 25dd, and the shutter plate 25da at the fourth reference point K4 make both light beams interrupted, again. Thus, the key position sensor 25d supplies a two-bit key position signal yd to the controller 210, and the two-bit binary code is stored in the register 51d.

The binary number is normalized to the normalized key position as shown in FIG. 6, and the positional deviation ex is determined at the subtractor 53. The other control sequence is similar to that in the servo control loop of the first embodiment, and no further description is hereinafter incorporated for avoiding repetition.

The automatic player piano implementing the fourth embodiment achieves all the advantages of the first embodiment. Moreover, the key position sensors 25d are so simple that the production cost is drastically reduced.

Although particular embodiments of the present invention have been shown and described, it will be apparent to those skilled in the art that various changes and modifications may be made without departing from the spirit and scope of the present invention.

The MM type velocity sensor and optical position transducer do not set any limit to the technical scope of the present invention. Any sort of velocity sensor and any sort of position transducer, which convert the velocity and position to electric signals through different physical phenomena, are available for the electric system 200.

The hammer sensors 26 are not indispensable. Only key sensors are incorporated in an electric system of an automatic player piano, and the hammer sensors 26 are deleted from the electric system 200. In this instance, the final hammer velocity and timing at which the hammers are brought into collision with the strings are presumed on the basis of pieces of key position data output from the key sensors.

The computer program may be loaded from an external program source into the controller 8. Otherwise, the computer program is stored in the external memory unit 43, and is transferred to the random access memory 42 before the acceptance of user's instructions.

The reference points may be less than or greater than 4, and the normalized key position yx may be deviated from the adjacent reference point by a certain value different from ±0.9 millimeter. The number of reference points and deviation are dependent on the resolution of the servo control loop. The more the reference points are, the more the candidates of the target stop are. If the automatic player piano is designed to keep the black and white keys 1*a*/1*b* at only one point at a certain keystroke, the key trajectory is divided into only two regions, and the servo control loop keeps the black and white keys around the target stop in the stop-and-go key motion. In this instance, only one photo-coupler may be provided for each of the black and white keys in order to tripper the counter. Nevertheless, the reference points or candidates of the target stop are usually equal to or less than nine, because the human being merely recognizes the difference among "7±2" within a short time period.

The distance between the normalized position and the target stop may be varied depending upon the key position. The counter may be triggered at several points on a non-linear line. Otherwise, the trigger points may be found on a hysteresis loop. A time lag from the transit time can make the counter increment and decrement the output along the hysteresis loop.

The counter 51 may be incremented and decremented by pieces of positional data determined through the integration of the pieces of velocity data yd. In this instance, the counter may accumulate the keystrokes expressed by the pieces of positional data.

The plunger sensors 35 may provide the pieces of position data expressing the current key position yk to the counter 51. In this instance, any key sensors 25 are not required for the servo control.

The velocity servo control may be deleted from the servo control loop shown in FIGS. 5 and 10. In this instance, the black and white keys 1*a*/1*b* are servo controlled on the basis of the positional deviation ex. The constant ru, which expresses the bias component, may be supplied to the servo control loop from the outside. The plunger sensor 35 may output a plunger position signal instead of the plunger velocity signal ym. In other words, key sensors 25 and plunger sensors 35 report a certain sort of physical quantity such as, for example, a keystroke or velocity to the controller.

A servo acceleration control may be further employed in the servo control loop. In this instance, a current acceleration, which is calculated on the basis of the current velocity through the differentiation, is compared with a target acceleration, and the acceleration deviation is amplified with a gain. The resultant product is added to the product uv or u. A servo force control may be also employable in the servo control loop. Thus, the servo position control and servo velocity control do not set any limit to the technical scope of the present invention.

The servo control loop of the present invention may be provided for another sort of manipulators such as, for example, pedals. Thus, the black and white keys 1*a*/1*b* do not set any limit to the technical scope of the present invention.

The present invention may appertain to another product. For example, the servo control technique of the present invention may be employed in an electronic tutor. The electronic tutor guides a trainee in fingering on the keyboard. For example, the electronic tutor sequentially moves the front portions of the black and white keys to intermediate key positions before the key positions at which the jacks escape from the hammers. Then, the trainee depresses the front portions of the black and white keys for producing the tones through an electronic tone generator. The electronic tutor may be installed in a training keyboard. The training keyboard is similar to the acoustic piano except for an impact absorber. The strings are replaced with the impact absorber so that the hammers are brought into collision with the impact absorber. For this reason, a trainee can practice the fingering without any acoustic tone.

Another applicable product is an exhibition of key pattern. While a pianist is taking a rest, a controller lays the black and white keys on a pattern, which makes the audience image a wave without any tone, by way of example. The audience enjoys the visual patterns before the next performance. In this instance, nine reference points may be prepared for the exhibition. Thus, the automatic player piano does not set any limit to the technical scope of the present invention.

Of course, the automatic player, electronic tutor and controller for the visual images may be installed in another sort of musical instrument such as, for example, a wind instrument or a percussion instrument.

The component parts of the embodiments are correlated with claim languages as follows.

The black and white keys 1*a*/1*b* serve as "manipulators", and the stop-and-go key motion is corresponding to "stop-and-go motion of said manipulators". The solenoid-operated key actuators 6 serve as "actuators", and driving signals ui and reference key trajectories are corresponding to "driving signals" and "reference trajectories", respectively. The key sensors 25 and plunger velocity sensors 35 serve as "sensors". Accordingly, the key position signals yk and plunger velocity signals ym are corresponding to "signals", and a series of values of key position and a series of values of plunger velocity/key velocity express "actual motion of said manipulators on actual trajectories". The controller 8 serves as a "data processing unit". A series of values of reference key position rx and a series of values of reference key velocity rv express "target motion of said manipulators on said reference trajectories", and the normalized key velocity yv and normalized key position yx are expressed by "the pieces of motion data already normalized." The duty ratio u is corresponding to a "magnitude". FIGS. 6 and 11 show a "normalizing" and steps S19 and S20 express "minimization".

The region between the rest position R and the reference point K1, region between the reference points K1 and K2, . . . And region between the reference point K4 and the end position E are corresponding to "plural regions". When the target stop KX is determined at the reference point K2, the region between the reference points K1 and K2 and the region between the reference points K2 and K3 are corresponding to "one of said plural regions" and "another of said plural regions".

The action units 2, hammers 4, strings 4 and dampers 5 as a whole constitute a "tone generator", and the pitch of tones serves as an "attribute".

What is claimed is:

1. An automatic player for producing at least stop-and-go motion of manipulators of a musical instrument, comprising:

actuators provided in association with said manipulators, respectively, and responsive to driving signals so as to exert force on the associated manipulators, thereby moving the associated manipulators along reference trajectories on which target stops are respectively determined for said stop-and-go motion;

sensors monitoring said manipulators for producing signals representative of pieces of motion data expressing actual values of physical quantity in actual motion of said manipulators on actual trajectories; and a data processing unit including a motion controller determining pieces of control data expressing target values of said physical quantity in target motion of said manipulators on said reference trajectories, and outputting said pieces of control data at time intervals and a servo controller connected to said sensors, said motion controller and said actuators for a servo control on said manipulators, normalizing said pieces of motion data in such a manner as to express normalized values of said physical quantity less than said target values of said physical quantity at said target stops for the manipulators advancing toward said target stops and other normalized values of said physical quantity greater than said target values of said physical quantity at said target stops for the manipulators running over said target stop and adjusting said driving signal to a proper value of magnitude through minimization of a difference between said pieces of motion data already normalized and said pieces of control data.

2. The automatic player as set forth in claim 1, in which each of said actual trajectories is divided into plural regions, and one of said plural regions closer to a rest position of the associated manipulator than the target stop and another of said plural regions farther from said rest position than said target stop are respectively assigned one of said normalized values and one of said other normalized values, respectively, so that one of said manipulators in said one of said plural regions and said one of said manipulators in said another of said plural regions are urged toward said target stop.

3. The automatic player as set forth in claim 2, in which said physical quantity is a distance from said rest position.

4. The automatic player as set forth in claim 1, in which said pieces of motion data express actual position of said manipulators and actual velocity of said manipulators, and said pieces of control data express target position of said manipulators and target velocity of said manipulators.

5. The automatic player as set forth in claim 4, in which said servo controller normalizes the actual position in such a manner as to assign same normalized values and said other normalized values to regions closer to rest positions of said manipulators than said target stops and other regions farther from said rest positions than said target stops so that said driving signals cause said actuators to urge said manipulators toward said target stop.

6. The automatic player as set forth in claim 5, in which said servo controller adjusts said driving signals to said proper value of said magnitude in such a manner as to minimize a difference between said actual velocity and a modified target velocity determined on the basis of a difference between said normalized values or other normalized values and said target values at said target stops.

7. The automatic player as set forth in claim 5, in which said actual position is changed from said normalized values to said other normalized values when said manipulators exceed said target stops.

8. The automatic player as set forth in claim 7, in which said servo controller is triggered by said sensors when said manipulators exceed said target stops.

9. The automatic player as set forth in claim 5, in which said servo controller adjusts said driving signals to said proper value of said magnitude in such a manner as to minimize a difference between said actual velocity and a modified target velocity determined on the basis of a sum between a constant value and a difference between said normalized values or other normalized values and said target values at said target stops.

10. A musical instrument for producing tones through at least stop-and-go motion, comprising:

manipulators selectively moved in said at least stop-and-go motion for specifying an attribute of tones to be produced;

a linkwork connected to said manipulators so that said manipulators give rise to motion of said linkwork for producing said tones; and an automatic player for producing said at least stop-and-go motion of said manipulators, and including actuators provided in association with said manipulators, respectively, and responsive to driving signals so as to exert force on the associated manipulators, thereby moving the associated manipulators through said stop-and-go motion along reference trajectories on which target stops are determined, sensors monitoring said manipulators for producing signals representative of pieces of motion data expressing actual values of physical quantity in actual motion of said manipulators on actual trajectories and a data processing unit having a motion controller determining pieces of control data expressing target values of said physical quantity in target motion of said manipulators on said reference trajectories, and outputting said pieces of control data at time intervals and a servo controller connected to said sensors, said motion controller and said actuators for a servo control on said manipulators, normalizing said pieces of motion data in such a manner as to express normalized values of said physical quantity less than said target values of said physical quantity at said target stops for the manipulators advancing toward said target stops and other normalized values of said physical quantity greater than said target values of said physical quantity at said target stops for the manipulators running over said target stops and adjusting said driving signal to a proper value of magnitude through minimization of a difference between said pieces of motion data already normalized and said pieces of control data.

11. The musical instrument as set forth in claim 10, in which black keys and white keys serve as said manipulators, and action units, hammers, strings and dampers as a whole constitute said linkwork.

12. The musical instrument as set forth in claim 10, in which said pieces of motion data express actual position of said manipulators and actual velocity of said manipulators, and said pieces of control data express at least target position of said manipulators and target velocity of said manipulators.

13. The musical instrument as set forth in claim 12, in which said servo controller normalizes the actual position in such a manner as to assign said normalized values and said other normalized values to regions closer to rest position of said manipulators than said target stops and said other normalized values to other regions farther from said rest positions than said target stops so that said driving signals cause said actuators to urge said manipulators toward said target stops.

14. The musical instrument as set forth in claim 13, in which said servo controller adjusts said driving signals to said proper value of said magnitude in such a manner as to minimize a difference between said actual velocity and a modified target velocity determined on the basis of a difference between said normalized values or other normalized values and said target values at said target stops.

15. The musical instrument as set forth in claim 13, in which said servo controller adjusts said driving signals to said proper value of said magnitude in such a manner as to minimize a difference between said actual velocity and a modified target velocity determined on the basis of a sum between a constant value and a difference between said normalized values or other normalized values and said target values at said target stops.

16. The musical instrument as set forth in claim 13, in which said actual position is changed from said normalized values to said other normalized values when said manipulators exceed said target stops.

17. The musical instrument as set forth in claim 16, in which said servo controller is triggered by said sensors when said manipulators exceed said target stops.

18. The musical instrument as set forth in claim 10, in which said automatic player further produces continuous motion in which said manipulators travels on said reference trajectories without said target stops.

19. The musical instrument as set forth in claim 18, in which said pieces of motion data express actual position on said actual trajectories for said continuous motion of said manipulators and actual velocity in said continuous motion, and said pieces of control data express at least target positions on said reference trajectories for said continuous motion of said manipulators and target velocity in said continuous motion.

20. The musical instrument as set forth in claim 19, in which said servo controller minimizes a difference between said target position and said actual position to zero, and adjusts said driving signals to another proper value of said magnitude for minimizing a difference between said target velocity and said actual velocity.

* * * * *